US011884459B2

(12) United States Patent
Fiere

(10) Patent No.: US 11,884,459 B2
(45) Date of Patent: Jan. 30, 2024

(54) SPOUTED POUCH AND A CLOSURE ASSEMBLY

(71) Applicant: Scholle IPN IP BV, SX Tilburg (NL)

(72) Inventor: Jeroen Pieter Fiere, SX Tilburg (NL)

(73) Assignee: Scholle IPN IP B.V., SX Tilburg (NL)

( * ) Notice: Subject to any disclaimer, the term of this patent is extended or adjusted under 35 U.S.C. 154(b) by 0 days.

(21) Appl. No.: 18/032,166

(22) PCT Filed: Oct. 14, 2021

(86) PCT No.: PCT/EP2021/078418
§ 371 (c)(1),
(2) Date: Apr. 14, 2023

(87) PCT Pub. No.: WO2022/079154
PCT Pub. Date: Apr. 21, 2022

(65) Prior Publication Data

US 2023/0348155 A1 Nov. 2, 2023

(30) Foreign Application Priority Data

Oct. 15, 2020 (NL) ..... 2026679

(51) Int. Cl.
*B65D 47/20* (2006.01)
*B65D 75/58* (2006.01)
(Continued)

(52) U.S. Cl.
CPC ..... *B65D 47/2093* (2013.01); *B65D 41/3428* (2013.01); *B65D 47/247* (2013.01);
(Continued)

(58) Field of Classification Search
None
See application file for complete search history.

(56) References Cited

U.S. PATENT DOCUMENTS 9,963,279 B2 * 5/2018 Huber ..... B67D 3/0051
10,065,849 B2 * 9/2018 Van Der Molen ..... F16K 41/04
(Continued)

FOREIGN PATENT DOCUMENTS

WO 2012033405 A1 3/2012
WO WO-2017052364 A1 * 3/2017 ..... B65B 3/045
(Continued)

*Primary Examiner* — Paul R Durand
*Assistant Examiner* — Michael J. Melaragno
(74) *Attorney, Agent, or Firm* — The Watson IP Group, PLC; Jovan N. Jovanovic

(57) ABSTRACT

A spouted pouch (1) has a spout (10) with a neck (14) extending upward from an attachment portion (12). A cap unit (30) has a cap body (35) and an integrated ring member (50), made as one piece of plastic. A ring member is integrally formed to the lower edge of the skirt of the cap body and comprises an annular base portion (51) connected via breakable bridges (53) to the skirt. The base portion and the spout body (11) have cooperating permanent snap-fit joint portions (56, 21, 23) that keep the ring member fixed to the spout upon removal of the cap body. The pouch further comprises a flow control device (80) made distinct from the spout and from the cap unit. The flow control device is mounted to the neck (14) and has an external part (82) located outside of the exterior surface of the neck. The cap body is arranged over the neck and the flow control device. The ring member and the external part of the flow control device have cooperating retention portions (55, 83).

11 Claims, 17 Drawing Sheets

(51) Int. Cl.
*B65D 55/16* (2006.01)
*B65D 47/24* (2006.01)
*B65D 41/34* (2006.01)

(52) U.S. Cl.
CPC ..... *B65D 55/16* (2013.01); *B65D 75/5883* (2013.01); *B65D 2251/023* (2013.01); *B65D 2251/065* (2013.01); *B65D 2401/50* (2020.05); *B65D 2575/586* (2013.01)

(56) References Cited

U.S. PATENT DOCUMENTS 10,159,366 B2 * 12/2018 Van Der Molen ..... A47G 19/2266
10,829,286 B2 * 11/2020 Murray ..... B65B 55/025
D913,093 S * 3/2021 Van Den Hoonaard ..... A63H 33/08 D9/443
10,974,884 B2 * 4/2021 Van Der Molen ..... B65D 41/3428
11,167,903 B2 * 11/2021 Murray ..... B65D 75/5883
2015/0147430 A1 * 5/2015 Dzikowicz ..... B65D 47/2031 222/545
2017/0066571 A1 * 3/2017 Panec ..... B65D 47/122
2017/0081064 A1 * 3/2017 van der Meijden .. B65B 55/027
2017/0081065 A1 * 3/2017 Fitzgerald ..... B08B 3/022
2017/0081086 A1 * 3/2017 Fiere ..... B65D 51/18
2018/0346219 A1 * 12/2018 Murray ..... B65D 75/5883
2019/0000716 A1 * 1/2019 Fiere ..... A61J 1/2037
2020/0039704 A1 * 2/2020 Habitz ..... B65D 75/5883
2021/0122551 A1 * 4/2021 Murray ..... B65B 55/08
2021/0354896 A1 * 11/2021 Fiere ..... B65D 75/5883
2022/0055815 A1 * 2/2022 Fiere ..... B65D 47/2031
2022/0204235 A1 * 6/2022 Van Spronsen ..... B65D 55/16
2023/0094576 A1 * 3/2023 Van Spronsen .... B65D 75/5883 222/566
2023/0257169 A1 * 8/2023 Lohrman ..... B65D 41/3428 215/252

FOREIGN PATENT DOCUMENTS

WO 2017135824 A1 8/2017
WO 2020050712 A1 3/2020
WO WO-2022079154 A1 * 4/2022

* cited by examiner

SPOUTED POUCH AND A CLOSURE ASSEMBLY

The present invention relates to a spouted pouch, to a closure assembly for a spouted pouch, and a method for manufacturing spouted pouches filled with a product to be dispensed from the pouch.

In WO2017/135824 and in WO2020/050712 spouted pouches are disclosed according to the preamble of claim 1. These known pouches have, when filled and ready for distribution to users, a flexible material pouch body that is filled with a product to be dispensed. The pouch is provided with a closure assembly that is generally composed of two components, namely a spout and a cap unit. The spout has a plastic spout body with at a lower end thereof an attachment portion that is attached to the pouch body. At an upper end thereof the spout body has a tubular neck, which neck has an interior surface that delimits a section of a product passage that extends through the spout body and has an exterior surface. The cap unit is made, e.g. moulded, as one piece of plastic material distinct from the spout. The cap unit comprises a cap body and an integrated ring member. Herein the cap body comprises a top wall structure and a downward depending skirt having an interior side, exterior side, and a lower edge remote from the top wall structure. The ring member is integrally formed to the lower edge of the skirt of the cap body. The ring member comprising an annular base portion which is connected at least via one or more breakable bridges to the skirt of the cap body. These breakable bridges break upon first time removal of the cap body by a user for dispensing of product from the pouch.

In WO2017/135824 and in WO2020/050712 various structural designs are disclosed of cooperating permanent snap-fit joint portions on the annular base portion and on the spout body, which cooperating permanent snap-fit joint portions allow for snap-fitting the cap unit on the spout and then keep the ring member fixed to the spout upon removal of the cap by the user.

It is disclosed in these prior art documents, that a pouch provided with a spout can be filled via the product passage and then the cap unit is snap-fitted on the spout in an axial securing motion relative to the neck of the spout. The cap body is herein configured to seal or close the product passage in a closed position thereof, which position is obtained by snap-fitting the cap unit on the spout.

According to a first aspect thereof, the present invention aims to provided spouted pouches having an enhanced dispensing functionality.

The first aspect of the invention provides a spouted pouch according to claim 1. Instead of the two-component closure assembly as discussed with reference to WO2017/135824 and WO2020/050712 a further, third component is provided which is embodied as a flow control device. This third component is made distinct from the spout and from the cap unit. The flow control device is mounted to the neck and has an external part that is located outside of the exterior surface of the neck. In general terms, the flow control device is configured to provide a form of control of the flow of product from the pouch body through the product passage.

Examples of flow control are discussed below in more detail. The cap body is arranged over the neck and the flow control device.

In the first aspect of the invention the ring member and the external part of the flow control device have cooperating retention portions that retain the flow control device relative to the spout. So, the ring member provides for retention of the flow control device, this in addition to its role in snap-fitting the cap unit on the spout and its role in the tamper-evident functionality of the spouted pouch. This approach, as preferred, avoids the presence of any retention portions between the neck and the flow control device in order to keep the flow control device retained relative to the spout. This facilitates production of the spout and allows for easy combination of a spout with a variety of different flow control devices, e.g. reducing investments in molds, reducing costs and efforts for logistics in the production of closure assemblies, etc. In embodiments, the exterior of the spout is smooth, so devoid of any ribs, grooves, threading, etc.

The flow control device may have a variety of embodiments, e.g. depending on the desired functionality.

For example, the flow control device may be embodied as a valve. For example, the valve is a self-closing valve that opens upon the user squeezing the pouch, e.g. a slit valve or a duckbill valve. In another embodiment, the valve is a push-pull valve with a slidable valve member that is opened and closed by the user, e.g. for drinking from the pouch.

The provision of a valve, e.g. a push-pull valve or a self-closing valve, e.g. a slit valve, for example, allows for the packaging of easily flowing, e.g. watery, products in the pouch without undue risk of inadvertent spillage. For example, a low viscosity beverage, such as water or the like, can be filled in the pouch.

For example, a slit valve member is made of silicone material or a thermoplastic elastomer material.

For example, the flow control device may be embodied as a non-operable flow restrictor that restricts the flow of product, e.g. by defining one or more outflow openings that are smaller than the product passage through the neck. In embodiments, the non-operable flow restrictor has a single opening of a shape differing from the cross-section of the product passage through the neck. For example, the flow of product being used for decoration in food production. In an embodiment, the cap body is configured to seal the one or more outflow openings of the flow restrictor in a closed position of the cap body on the spout.

In an embodiment, the cooperating retention portions of the ring member and the external part of the flow control device retain the flow control device relative to the spout in one fixed position, so immobile relative to the spout. This is, for example, envisaged in conjunction with the flow control device embodied as a valve that requires no motion relative to the neck, e.g. as a self-closing valve embodied as a slit valve. A fixed position retention is also envisaged for embodiments of the flow control device as a flow restrictor.

In an embodiment, the cooperating retention portions of the ring member and the external part of the flow control device allow for motion of the flow control device relative to the spout at least, or solely, in direction of the neck, so up and down along the neck, yet without the flow control device becoming dismounted from the neck. For example, the flow control device is mobile up and down relative to the neck between a closed position and an opened position.

In an embodiment, the cooperating retention portion of the ring member and the external part of the flow control device allow for rotary motion of the flow control device relative to the spout, so about the neck of the spout, yet without the flow control device becoming dismounted from the neck. For example, the flow control device is solely mobile in rotation about the neck between a closed position and an opened position.

In an embodiment, the flow control device is embodied to form a push-pull valve with a slidable valve member that is mounted on the neck so as to be slidable upward relative to the neck from a closed position to an opened position to open the product passage and downward to the closed position to close the product passage. Herein the slidable valve member has one or more sealing surfaces cooperating with one or more sealing surfaces of the neck of the spout in the closed position. The cooperating retention portions of the ring member and the slidable valve member, preferably, limit the upward motion of the slidable valve member relative to the neck, e.g. define the opened position slidable valve member. In an embodiment, the ring member and the slidable valve member have cooperating snap-fit portions that create a releasable snap-fit in at least one of the opened and the closed position of the slidable valve member, e.g. in both the opened and closed position.

In a practical embodiment, the external portion of the slidable valve member is embodied with a collar that extends around the exterior of the neck and with one or more outward protrusions forming one or more retention portions, e.g. a flange at a lowermost edge of the collar. The ring member is configured to allow for said up and down sliding of the slidable valve member, the ring member comprises a retention portion forming an abutment that defines the opened position of the slidable valve member. So, in practice, the ring member limits the upward motion of the slidable valve member by the user. The ring member herein absorbs the pull force exerted by the user when reaching the opened position, and said pull forces is distributed by the permanent snap-fit joint to the spout body.

In embodiments of the slidable valve member, the one or more sealing surfaces are located in proximity of the upper end of the neck. In a preferred embodiment, an internal seal is formed between a sealing surface on the inner surface of the neck located in proximity of the upper end of the neck and an inner annular portion of the slidable valve member that extends into the neck. In a preferred embodiment, in addition to the internal seal, an external seal is present between a sealing surface on the exterior surface of the neck and the collar of the slidable valve member.

In an embodiment, the slidable valve member has a transverse central wall portion and adjoining along a periphery thereof an upwardly extending inner annular wall portion forming a sealing surface of an internal seal that cooperates with a sealing surface on the inner surface of the neck, wherein the inner annular wall portion connects via a bridge wall portion to the collar that extends coaxially about the inner annular portion, and wherein an bottomed groove is present between the collar and the inner annular wall portion wherein the upper end of the neck is received. Preferably an outer seal is formed between the collar and the exterior of the neck, e.g. in proximity to the upper end of the neck, in the closed position of the valve member.

In an embodiment, the overcap body is a snap-on type overcap body providing in use of the closure assembly a snap-on functionality so that the overcap body can be replaced after first time removal of the overcap body, wherein the spout and/or the flow control device on the one hand and the overcap on the other hand are provided with cooperating snap connector formations to provide the snap-on functionality. For example, a light snap is provided for between the overcap body and the flow control device in combination with a stronger snap between the flow control device and the spout, e.g. the stronger snap holding a slidable valve member in its closed position as the user removes the overcap body through release of the lighter snap.

The skirt may be ribbed or the like to enhance grip of a user onto the overcap, e.g. provided with axial ribbing. In another embodiment the overcap body comprises one or more grip portions integral to the exterior side of the skirt to facilitate a user in opening the closure assembly for the first time, e.g. by manually rotating and/or lifting of the overcap body. Advantageously, the manually rotating of the cap at a first time opening of the closure assembly contributes to an effective breakage of the one or more bridges in between the base portion and the skirt of the overcap body, while the snap-on type overcap body subsequently allows a convenient re-placement of the cap body In an embodiment the cap body is provided with an outer annular grip portion around and spaced from the skirt, e.g. as disclosed in WO2014/007612.

In an embodiment, the overcap body comprises one or more wing-shaped handles, e.g. a pair of wing-shaped handles, e.g. just one pair of wing-shaped handles, e.g. as in WO2015/115891, said pair of wing-shaped handles extending outwardly from the skirt of the overcap body in mutually opposite directions and being configured to be engaged by a user for removal of the overcap body, wherein the wing-shaped handles body each have, seen in side view thereon, an outer periphery comprising a bottom side, a top side, and a tip remote from the skirt, where said bottom side and top side adjoin at the tip.

In an embodiment, the cap unit comprises a permanent strap that is integral at a first end thereof to the ring member and at a second end thereof integral to the cap body. The strap, which may also be called a leash, allows for removal of the cap body to provide access to the neck and flow control device, e.g. allowing for the user to drink from the pouch. In another embodiment, for example, the overcap body is hinged to the ring member, e.g. by a living hinge.

In an embodiment, the overcap has one or more wing-shaped handles, and a permanent strap of the cap unit is integral at a first end thereof to the base portion of the ring member and at a second end thereof integral to one of the one or more wing-shaped handles, wherein the strap is adapted to remain connected to both the base portion of the ring member and the respective wing-shaped handle upon removal of the overcap body by the user.

In an embodiment, the strap, prior to first time removal of the overcap by the user, is located in a plane, e.g. in a vertical plane, that is in common with a panel portion of the respective wing-shaped handle.

In an embodiment, the strap, prior to first time removal of the overcap by the user, extends outward from the base portion of the ring member towards the tip of the respective wing-shaped handle, e.g. the second end of the strap being inward of the tip of the wing-shaped handle.

In an embodiment, the strap extends outward from the base portion of the ring member towards the tip of the respective wing-shaped handle along the bottom side of the wing-shaped handle, further about the tip of the wing-shaped handle, and along a portion of the top side of the wing-shaped handle to the second end of the strap, e.g. the second end being located at a distance outward of the skirt.

In an embodiment, the integrated strap of the overcap comprises a strap inner contour side, facing towards the respective wing-shaped handle prior to the first time removal of the overcap, and a strap outer contour side, facing away from the respective wing-shaped handle.

In an embodiment, the snap-fit between the ring member and the spout is configured as is disclosed in WO2020/050712. In an embodiment, the annular base portion comprises one or more integrally formed hook members and the spout, e.g. a flange thereof around a lower section of the neck, comprises one or more hook member passages, each hook member passage being adapted to receive a hook member when the overcap unit is secured on the spout and over the neck and flow control device. For example, the spout is provided with an annular flange portion on the neck and a hook portion of each hook member engages, e.g. snaps, underneath a bottom face of said annular flange portion on the neck of the spout.

In an embodiment, the overcap unit comprises one or more breakable tamper-evident bridges located between the strap and the respective wing-shaped handle, said one or more breakable tamper-evident bridges breaking upon first time removal of the overcap by a user.

In an embodiment, the overcap is a quarter turn lift overcap.

In an embodiment, the closure assembly comprises:

at least one first cam portion defining a cam surface, which cam surface is angled with respect to a main axis, which first cam portion is integrally formed on one of the lower edge of the skirt and a portion of the ring member, and at least one second cam portion defining a cam follower surface adapted to interact with the cam surface of the first cam portion and which second cam portion is integrally formed on the other one of the lower edge of the skirt and said portion of the ring member wherein—upon first time opening of the closure assembly by rotation of the overcap relative about the neck—the first and second cam portions interact in order to cause axial lifting of the overcap, e.g. so that co-operating snap connector formations disengage.

In an embodiment, a pair of first cam portions is integrally formed at a top face of the ring member, at diametrically opposed locations, and a pair of second cam portions is integrally formed at the lower end of the skirt, at diametrically opposed locations.

In an embodiment, the first cam portion has an upwardly arched first cam surface with a centre raised above the flange-like base portion and with first and second ends where the arched first cam surface adjoins the top face of the flange-line base portion. For example, a breakable bridge is present at each end of the upwardly arched first cam surface.

In an embodiment, the second cam portion comprises a tab integrally formed at the lower edge of the skirt and adapted to cooperate with the first cam surface, preferably the overcap having two diametrically opposed tabs, e.g. protruding downward.

In an embodiment, the pair of wing-shaped handles extend in an imaginary vertical plane through the main axis of the neck, and wherein the cam portions of the pair of first cam portions are located on diametrically opposed locations relative to said imaginary vertical plane.

The first aspect of the invention, also relates to a method for production of filled spouted pouches, wherein the method comprises:

providing an empty pouch with a spout attached to the pouch body, filling the pouch with product via the product passage, providing a subassembly of the cap unit and the flow control member, e.g. the slidable valve member, wherein the flow control member is initially retained within the cap body, mounting the subassembly on the spout after filling of the pouch, said mounting involving pressing the subassembly onto the spout so that the flow control device becomes mounted to the neck and so that the cooperating permanent snap-fit joint portions of the annular base portion and the spout body engage and keep the ring member fixed to the spout.

The first aspect of the invention also relates to a method for production of filled spouted pouches, wherein the method comprises:

providing an empty pouch with a spout attachment location, e.g. an opening, e.g. an opening in a top edge or seam of a pouch, adapted to mount the fully assembled closure assembly as discussed herein on the pouch, filling the container, e.g. via the opening, mounting the fully assembled closure assembly as discussed herein as a unit on the pouch by attachment of the pouch body to the attachment portion of the spout, e.g. by heat sealing.

A second aspect of the present invention relates to a spouted pouch having a closure assembly and closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and an integral strap permanently securing the cap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, and wherein the overcap body, preferably, is a snap-on type overcap body providing in use of the closure assembly a snap-on functionality so that the overcap body can be replaced after first time removal of the overcap body, wherein the spout and the overcap are provided with cooperating snap connector formations to provide the snap-on functionality, wherein the overcap body comprises a pair of wing-shaped handles, e.g. just one pair of wing-shaped handles, said pair of wing-shaped handles extending outwardly from the skirt of the overcap body in mutually opposite directions and being configured to be engaged by a user for removal of the overcap body, wherein the wing-shaped handles each have, seen in a side view thereon, an outer periphery comprising a bottom side, a top side, and a tip remote from the skirt, where said bottom side and top side adjoin at the tip, wherein the strap is integral at a first end thereof to the base portion of the ring member and at a second end thereof integral to one of the wing-shaped handles, wherein the strap is adapted to remain connected to both the base portion of the ring member and the respective wing-shaped handle upon removal of the overcap body by the user.

As explained herein, due to the sealing functionality of the flow control device, e.g. embodied to provide the closure assembly with a push-pull valve functionality or some other valve, the overcap body need not have the functionality to provide a seal of the product passage and may, merely, have a protective function, that is hinder or avoid access to the neck and the closure device. The presence of wing-shaped handles allows for easy handling by the user of the overcap. The presence of the strap avoids the overcap becoming loose.

According to a third aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and an integral strap permanently securing the cap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, and wherein the overcap body, preferably, is a snap-on type overcap body providing in use of the closure assembly a snap-on functionality so that the overcap can be replaced on the spout after first time opening, wherein the spout and the overcap body are provided with cooperating snap connector formations to provide the snap-on functionality, wherein the closure assembly comprises:

at least one upwardly directed first cam portion defining a cam surface, which first cam portion is integrally formed on the base portion of the ring member, and at least one downwardly directed second cam portion defining a cam follower surface adapted to interact with the cam surface of the first cam portion, which second cam portion is integrally formed on the lower edge of the skirt, wherein—upon first time removal by rotation of the overcap body relative to the neck—the first and second cam portions interact in order to cause axial lifting of the overcap body, e.g. so that the co-operating snap connector formations disengage, wherein the strap is integral at a first end thereof to the upwardly directed first cam portion of the ring member and at a second end thereof integral to another portion of the overcap body, wherein the strap is adapted to remain connected to both the upwardly directed first cam portion of the tamper-evident ring member and said other portion of the overcap body upon removal of the overcap by the user.

According to a fourth aspect thereof, the invention provides for a spouted pouch having a closure assembly and a closure assembly for a spouted pouch, wherein the closure assembly comprises a spout, a flow control device, and a cap unit with a cap body, e.g. an overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a quarter turn lift cap body, an integrated ring member, and an integral strap permanently securing the cap body to the ring member, which cap unit has been made, e.g. moulded, as one piece of plastic material that is distinct from the spout, wherein the cap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is, optionally, configured to keep the product passage closed during a first time removal of the cap body by the user, wherein the cap body is arranged over the neck and the flow control device, and wherein the cap body, preferably, is a snap-on type cap body providing in use of the closure assembly a snap-on functionality, wherein the spout and/or the flow control device on the one hand, and the cap body on the other hand are provided with cooperating snap connector formations to provide the snap-on functionality, wherein the closure assembly comprises:

at least one first cam portion, e.g. an upwardly directed first cam portion, defining a cam surface, which cam surface is angled with respect to a main axis, which first cam portion is integrally formed on the ring member, and at least one second cam portion, e.g. a downwardly directed second cam portion, defining a cam follower surface adapted to interact with the cam surface of the first cam portion and which second cam portion is integrally formed on the lower edge of the skirt, wherein—upon first time removal by rotation of the cap over a quarter turn—the first and second cam portions interact in order to cause axial lifting of the overcap body, e.g. so that co-operating snap connector formations disengage, wherein the strap is integral at a first end thereof to the tamper-evident ring member and at a second end thereof integral to another portion of the cap body, wherein the strap is adapted to remain connected to both the ring member and said other portion of the cap body upon said first time removal of the cap body by the user.

According to a fifth aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and, optionally, an integral strap permanently securing the cap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, and wherein the overcap body, preferably, is a snap-on type overcap body providing in use of the closure assembly a snap-on functionality, wherein the overcap body is provided with two latch portions, e.g. two latch tabs, at diametrically opposed locations, which latch portions are configured to provide a releasable snap connection between the overcap body and the spout, wherein the latch tabs on the overcap body are each configured to be received or are received in a corresponding recess or window in a wall portion of the spout allowing to snap the overcap onto the spout, e.g. in an axial securing motion of the overcap body, wherein, preferably, a strap is integral at a first end thereof to the base portion of the ring member and at a second end thereof integral to another portion of the overcap body, e.g. to a wing-shaped handle of the overcap body, wherein the strap is adapted to remain connected to both the base portion of the ring member and the respective other portion of the overcap body upon removal of the overcap by the user.

According to a sixth aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and an integral strap permanently securing the cap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, wherein the overcap comprises at least one handle having a panel portion, e.g. one pair of handles, said handle extending outwardly from the skirt of the overcap and being configured to be engaged by a user for removal of the overcap, wherein each handle has, seen in side view thereon, an outer periphery comprising a bottom side, a top side, and a tip remote from the skirt, where said bottom side and top side adjoin at the tip, wherein the strap is integral at a first end thereof to the base portion of the ring member and at a second end thereof integral to the handle, wherein the strap is adapted to remain connected to both the base portion of the ring member and the respective handle upon removal of the overcap by the user, and wherein, the strap, prior to first time removal of the overcap by the user, is located in a plane, e.g. in a vertical plane, that is in common with the panel portion of the respective handle.

According to a seventh aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and an integral strap permanently securing the cap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, wherein the spout has a circumferential wall which is positioned around a bottom region of the neck and spaced from the neck, thereby forming an inner space which is open from above and adapted to receive the annular base portion of the ring member of the overcap therein, wherein, for example, the circumferential wall is erected on a circumferential flange of the spout that extends around the neck, wherein the annular base portion is provided with at least one snap portion, and wherein the circumferential wall is provided with a complementary snap formation, e.g. with a window through the circumferential wall from a wall outer face to a wall inner face, such that the snap portion snaps onto or into the complementary snap formation, e.g. into the window, when the cap unit is placed on the spout and the annular base portion is at least partially inserted into the inner space, which snap connection is such that the base portion remains fixed to the spout upon removal of the overcap body by the user, wherein a top region of the annular base portion protrudes upwardly above the circumferential wall, and wherein the strap adjoins at a first end thereof this upwardly protruding top region, and wherein the strap adjoins at a second end thereof another portion of the overcap, wherein the strap is adapted to remain connected upon removal of the overcap by the user.

According to an eight aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a protective overcap body, an integrated ring member, and an integral strap permanently securing the overcap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, wherein the spout has a circumferential wall which is positioned around a bottom region of the neck and is spaced from the neck, thereby forming an inner space which is open from above and adapted to receive therein the annular base portion of the ring member of the overcap, wherein, for example, the circumferential wall is erected on a circumferential flange that extends around the neck, wherein the annular base portion is provided with at least one snap portion and wherein the circumferential wall is provided with a complementary snap formation, e.g. with a window through the circumferential wall from a wall outer face to a wall inner face, such that the snap portion snaps onto or into the complementary snap formation, e.g. into the window, when the cap unit is placed on the spout and the annular base portion is at least partially inserted into the inner space, which snap connection is such that the base portion remains connected to the spout upon removal of the overcap body by the user, wherein the circumferential wall and the overcap body are provided with cooperating latching formations which are configured to form a snap connection when the overcap body is placed on the spout and to become unsnapped upon removal of the overcap body.

According to a ninth aspect thereof, the invention provides for a spouted pouch having a closure assembly and a closure assembly for a spouted pouch, wherein the closure assembly comprises a spout, a flow control device, and a cap unit with a protective overcap body, wherein:

the spout has a spout body with an attachment portion that is attached or attachable to a flexible material pouch body, wherein said spout body has a tubular neck extending upward from said attachment portion, which neck delimits a section of a product passage that extends through the spout body, said neck having an exterior surface, a cap unit comprising a quarter turn lift protective overcap body, an integrated ring member, and an integral strap permanently securing the overcap body to the ring member, which cap unit has been made, e.g. moulded, as one piece of plastic material that is distinct from the spout, wherein the overcap body comprises a top wall structure and a downward depending skirt having an interior side, exterior side, and a lower edge remote from the top wall structure, wherein the ring member is integrally formed to the lower edge of the skirt of the overcap body, said ring member comprising an annular base portion which is connected at least via one or more breakable bridges to the skirt of the overcap body, said one or more breakable bridges breaking upon first time removal of the overcap body by a user for dispensing of product from the pouch via the product passage, a flow control device which is mounted to the neck and is configured to provide control of the flow of product from the pouch body through the product passage, wherein the flow control device is configured to keep the product passage closed during a first time removal of the protective overcap body by the user, wherein the overcap body is arranged over the neck and the flow control device, and wherein the overcap body, preferably, is a snap-on type overcap body providing in use of the closure assembly a snap-on functionality, wherein the overcap body comprises at least one handle configured to be engaged by a user for removal of the overcap body, e.g. one pair of diametrically opposed handles, e.g. wing-shaped handles, wherein the handle has a panel portion extending outwardly from the skirt of the overcap body, which panel portion has opposing main panel faces, said main faces each being bounded, seen in side view onto the cap, by a bottom side, a top side, and a tip of the panel portion, wherein the handle further has at least one reinforcing top protrusion that is integral with at least a portion of the top side of the panel portion and which top protrusion protrudes away from main face of the panel portion so as to reinforce the panel, wherein the strap is integral at a first end thereof to the base portion of the ring member and extends from said first end along the bottom side of the panel portion about the tip of the panel portion to a second end of the strap, wherein the second end of the strap adjoins the outer end of the reinforcing top protrusion.

It will be appreciated that any of the second to ninth aspect of the invention can be supplemented by one or more of the technical features discussed herein with reference to the first aspect of the invention or to any other aspect of the invention.

The invention will now be discussed with reference to the drawings. In the drawings.

Figure 1:
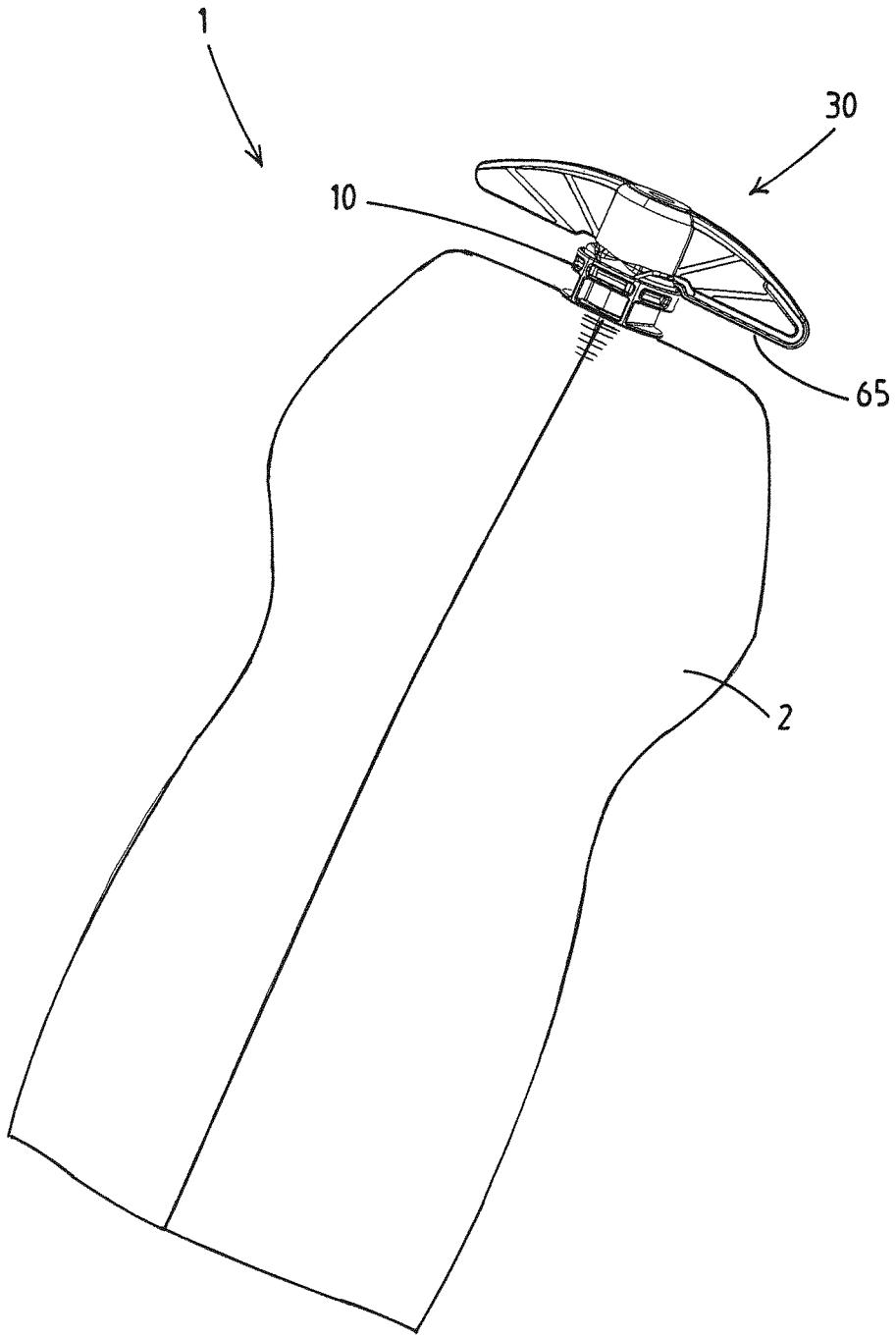
FIG. 1 shows an example of a spouted pouch according to the invention.
Figure 2:
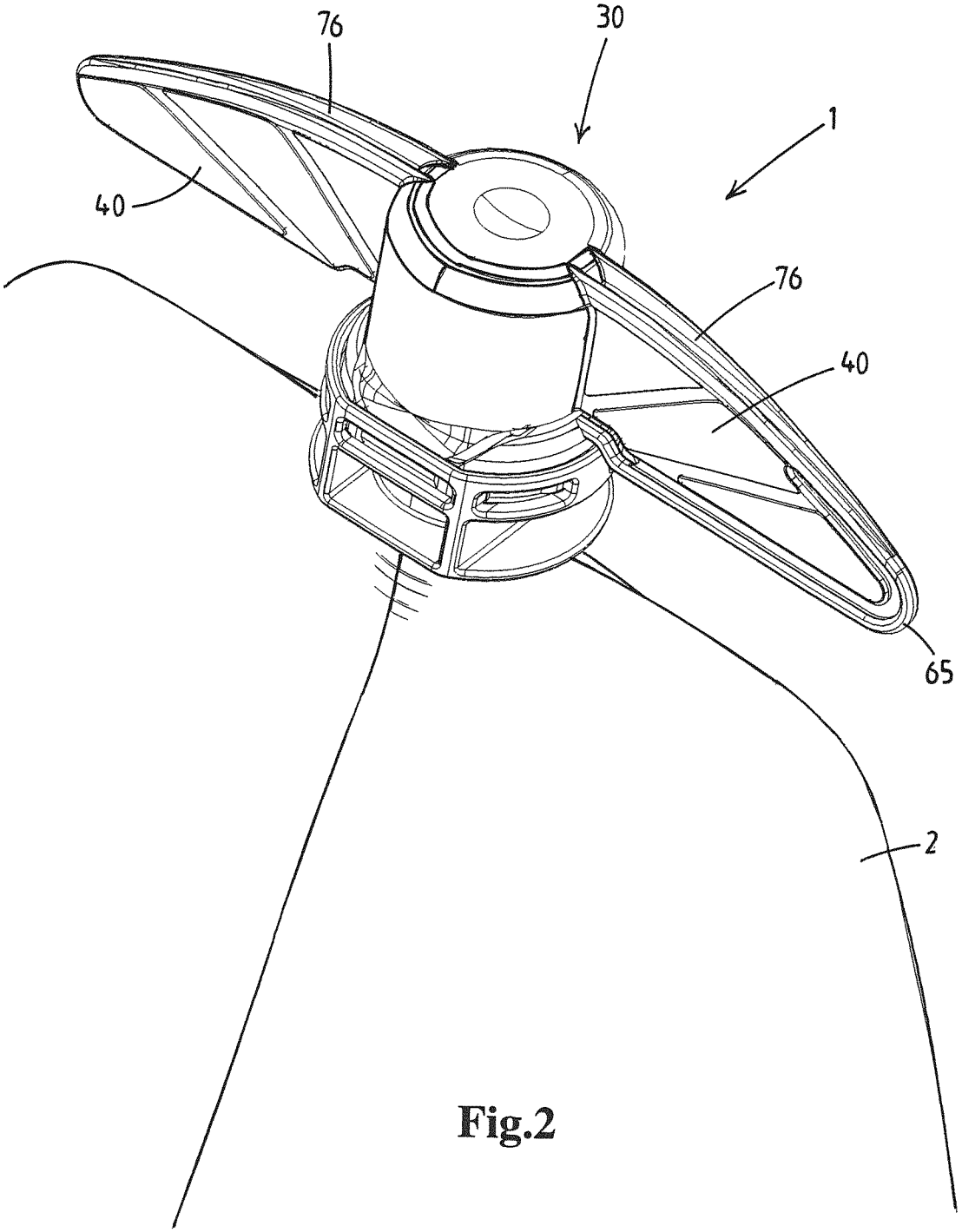
FIG. 2 shows the top portion of the pouch of FIG. 1.
Figure 3:
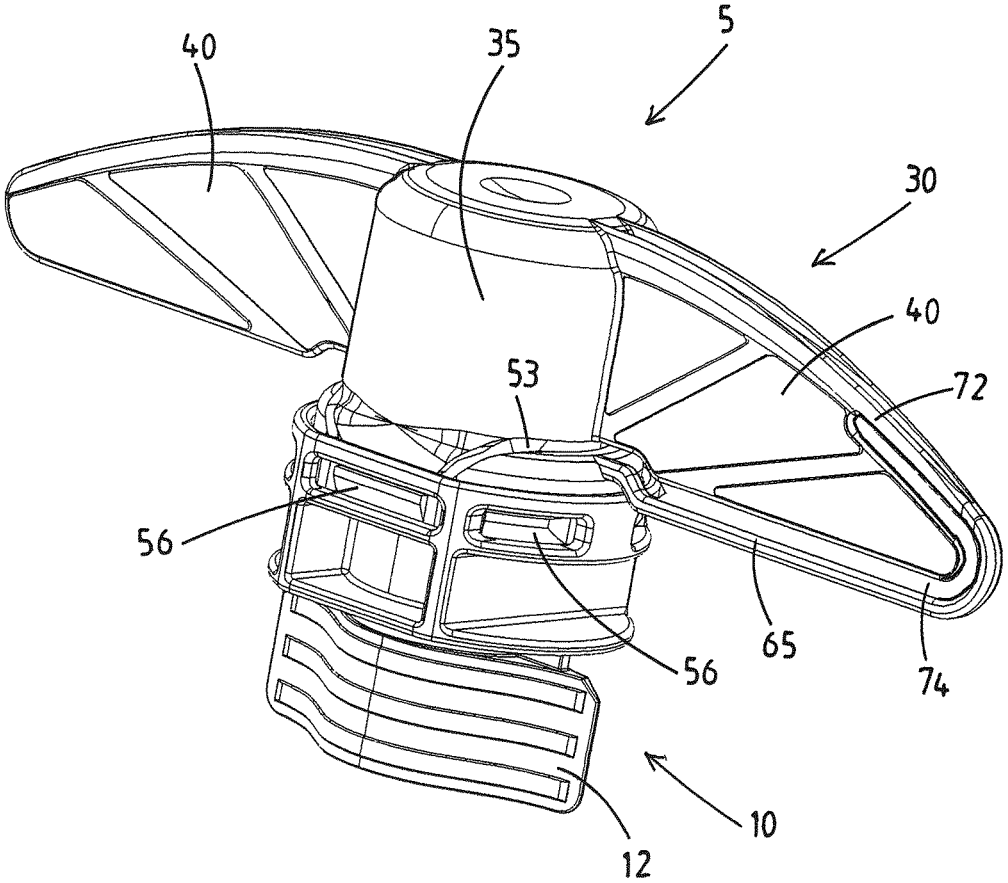
Figure 4:
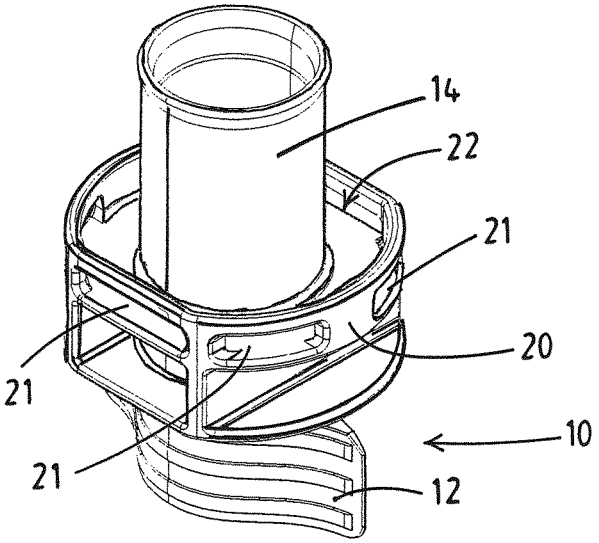
Figure 4:
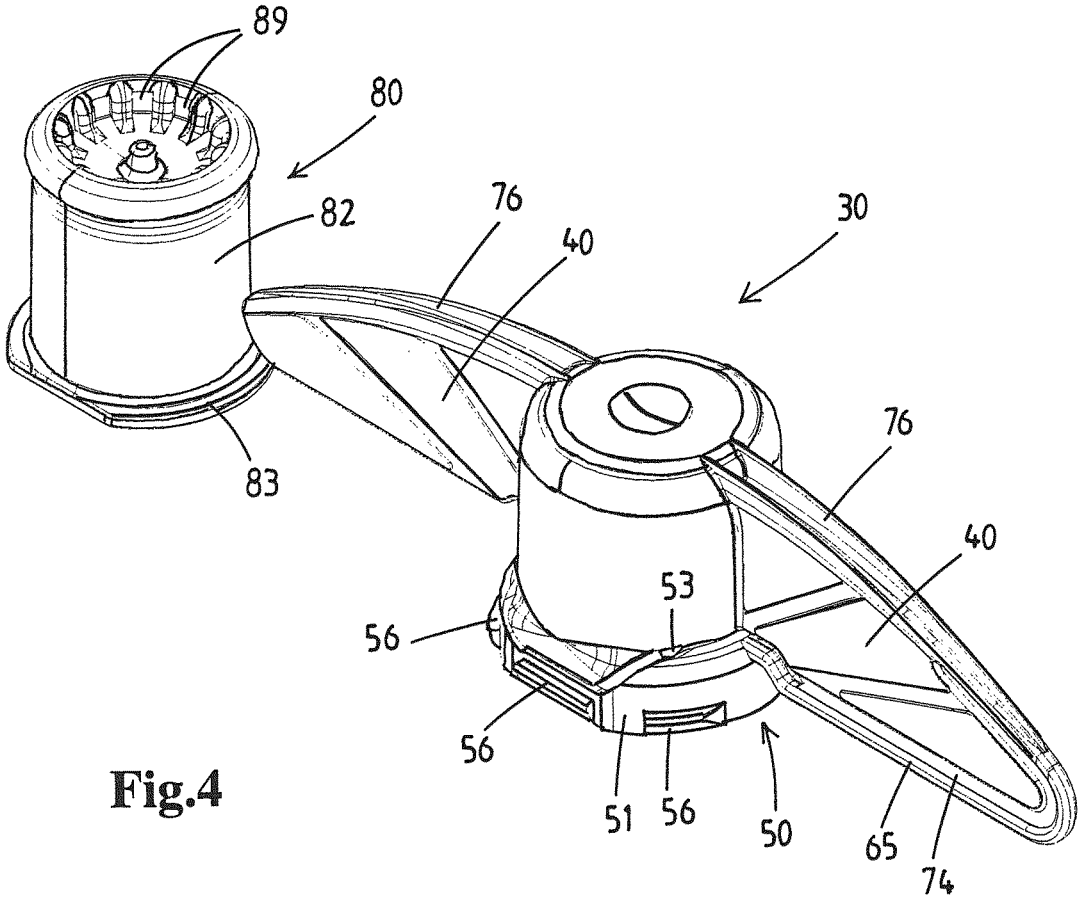
Figure 5:
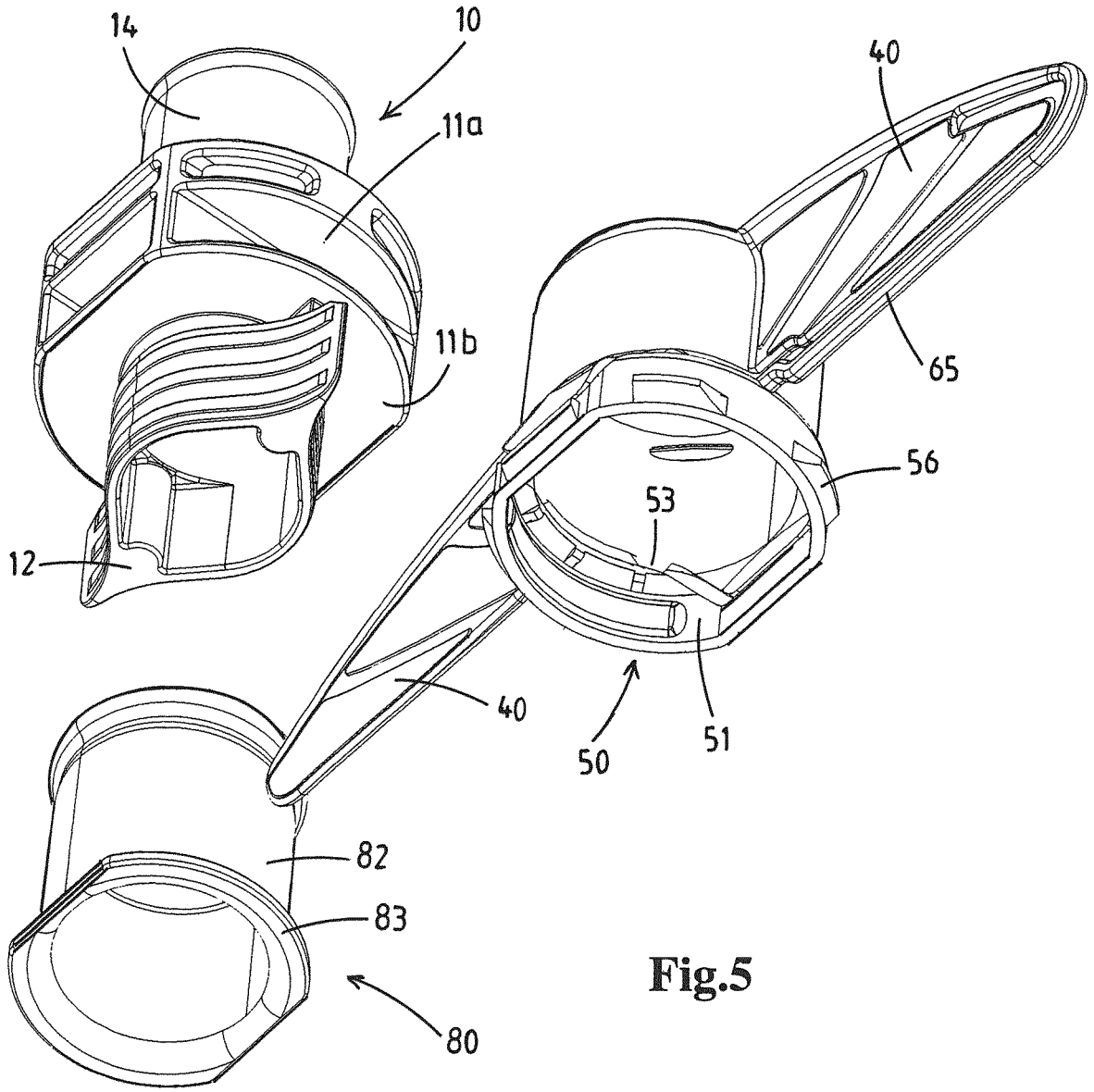
Figure 6:
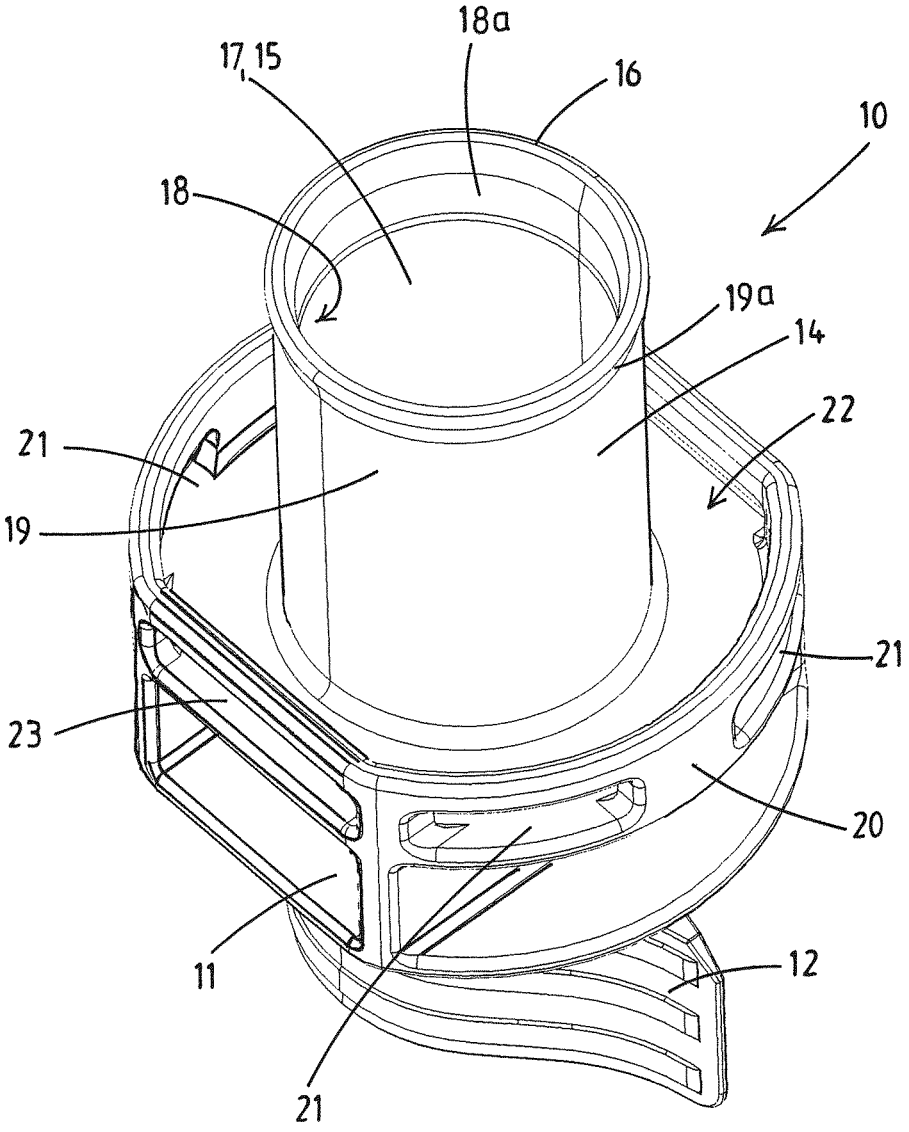
Figure 7:
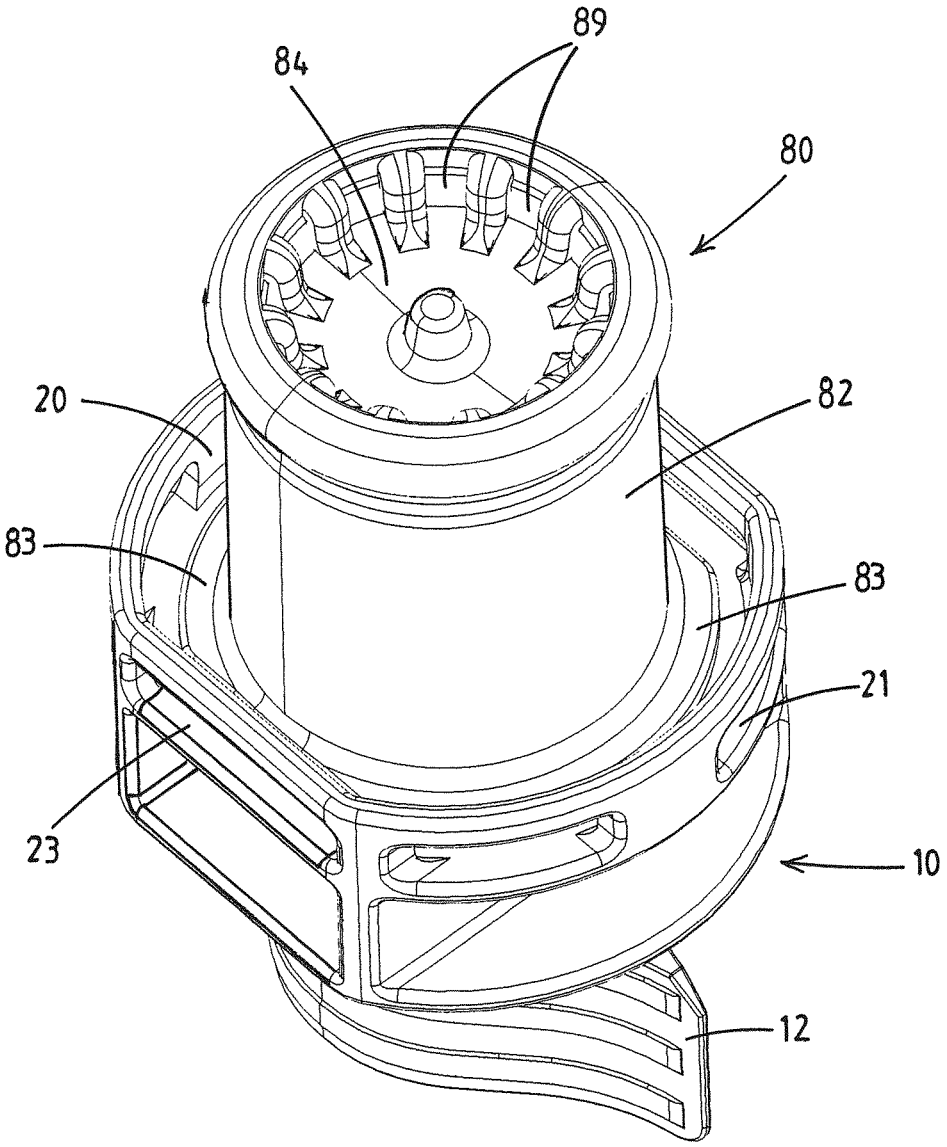
Figure 8:
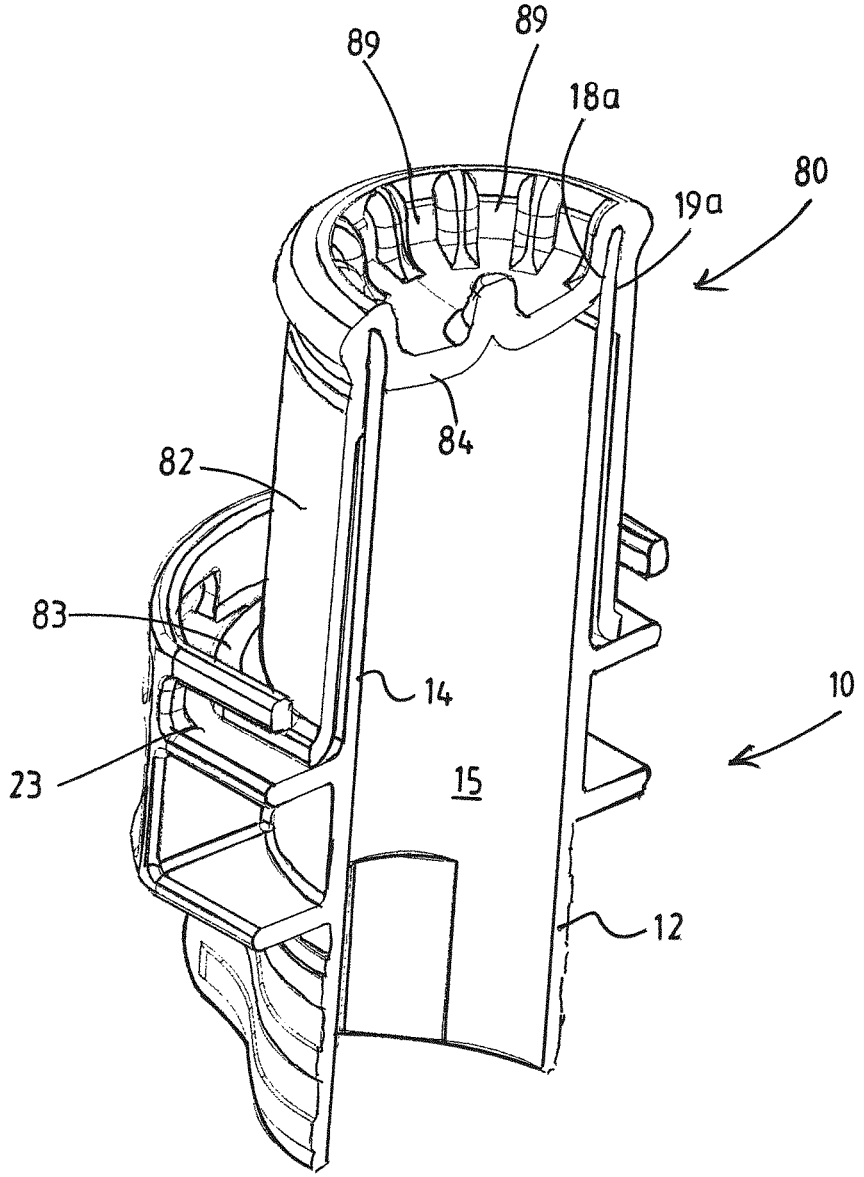
Figure 9:
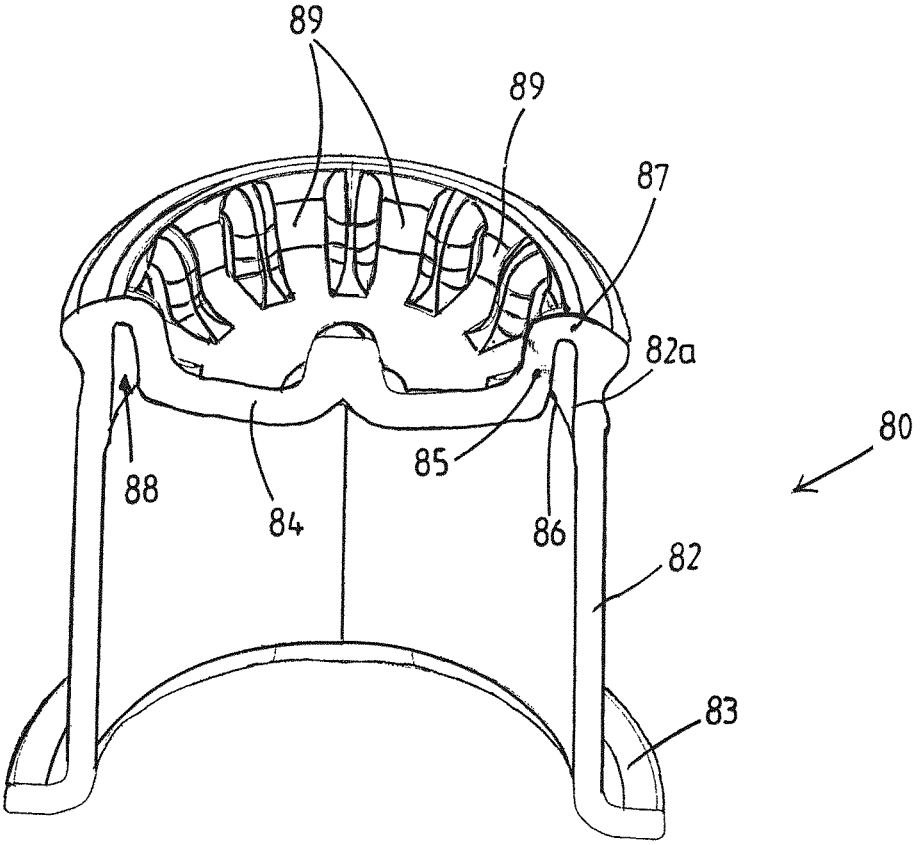
Figure 10:
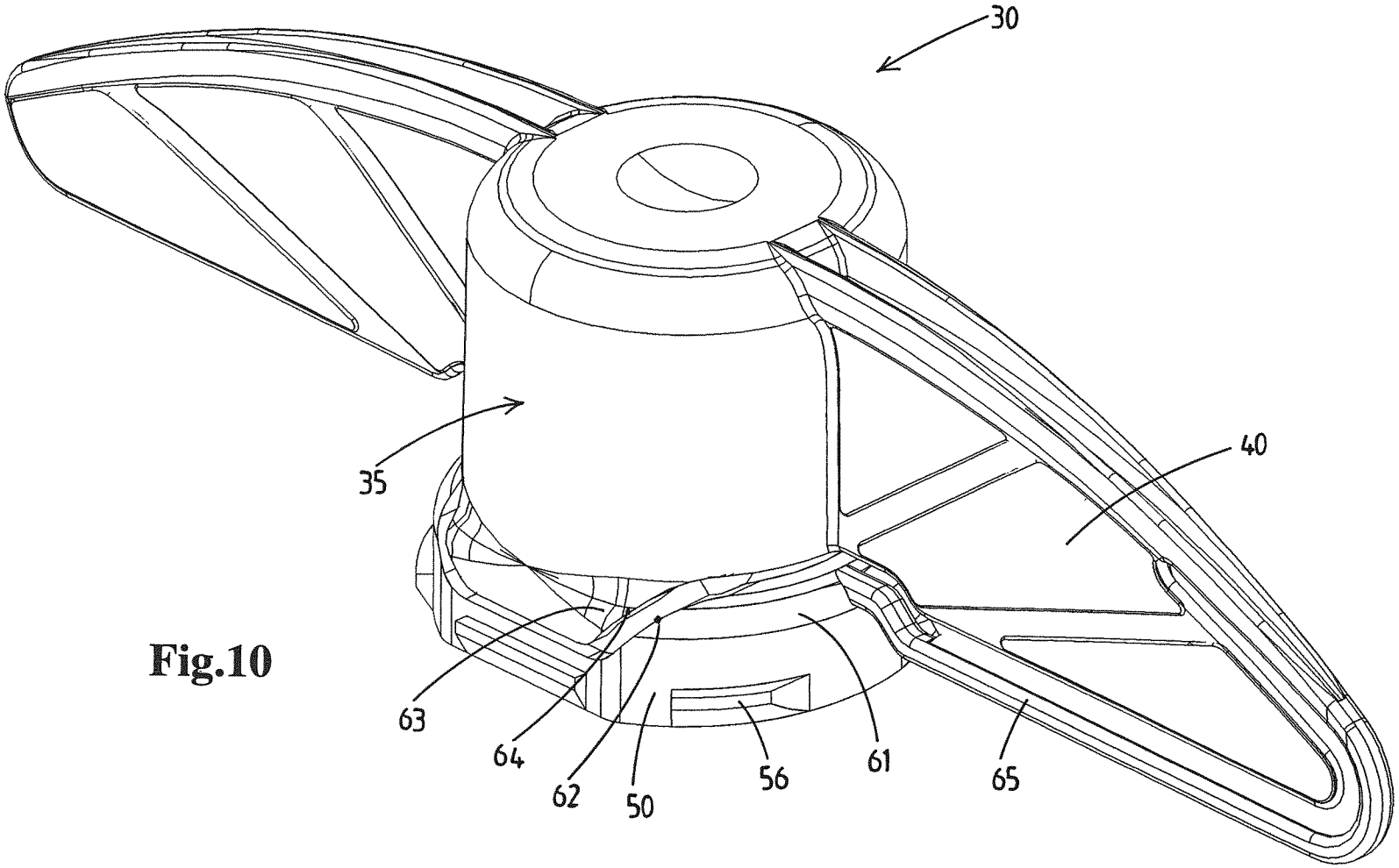
Figure 11:
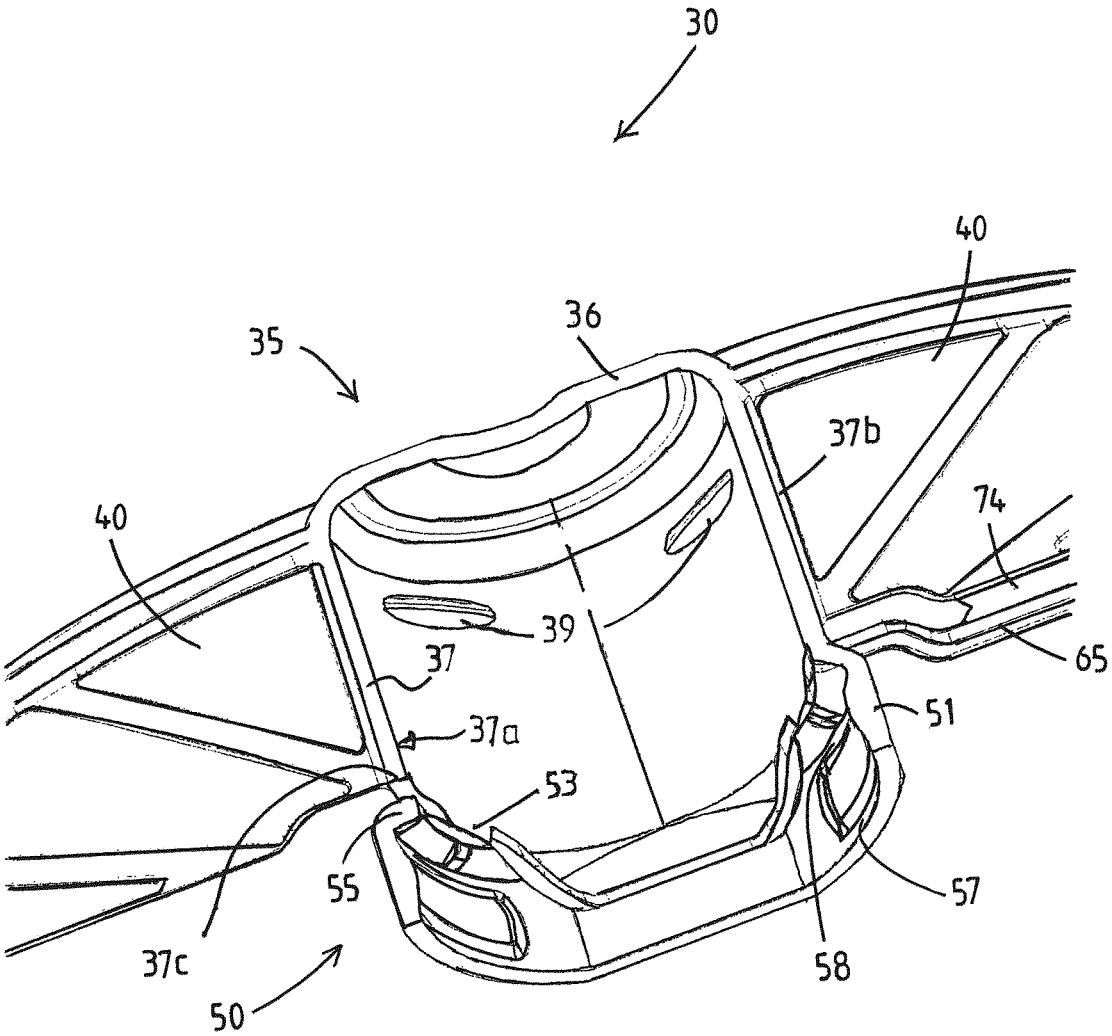
Figure 12:
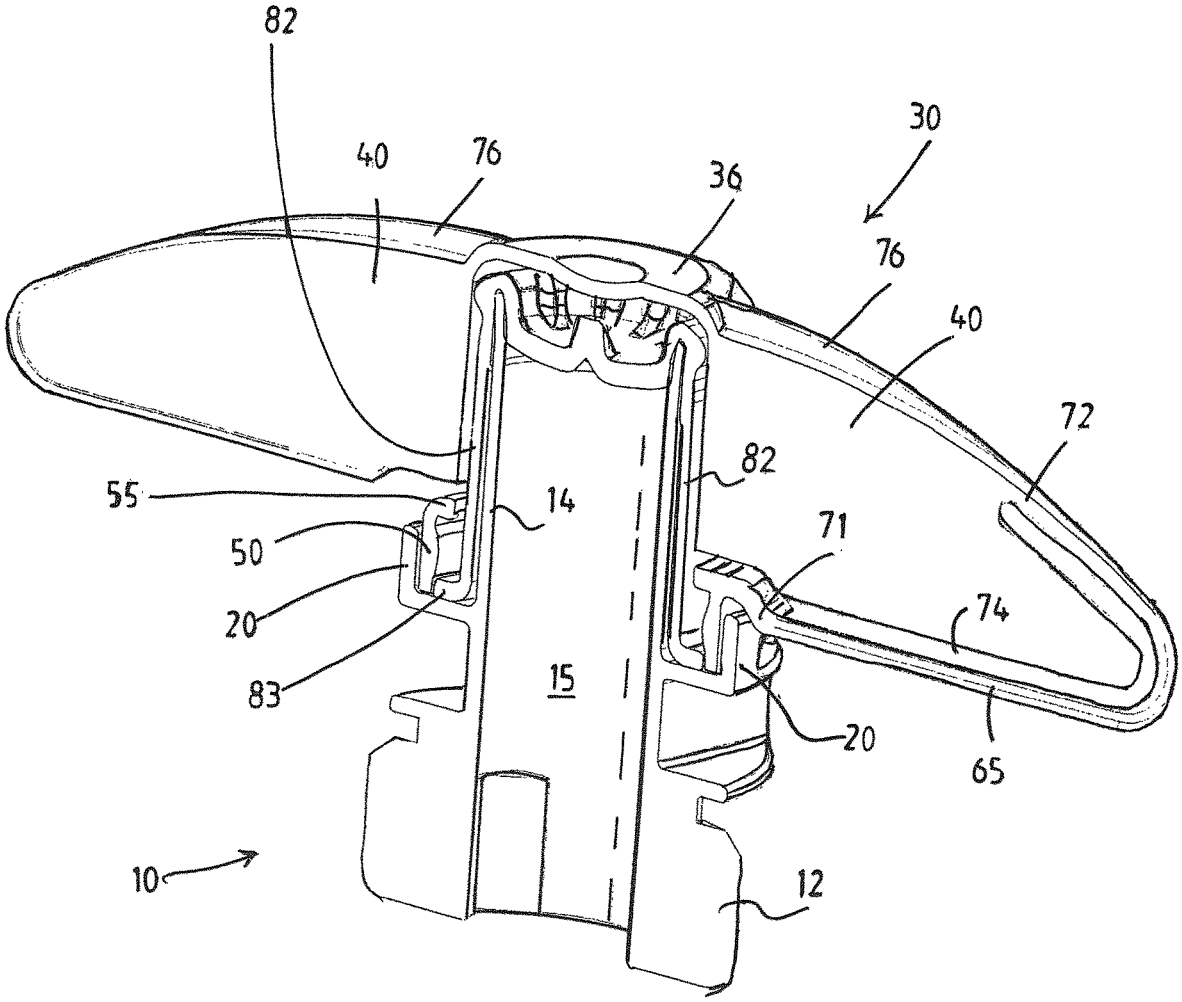
Figure 13:
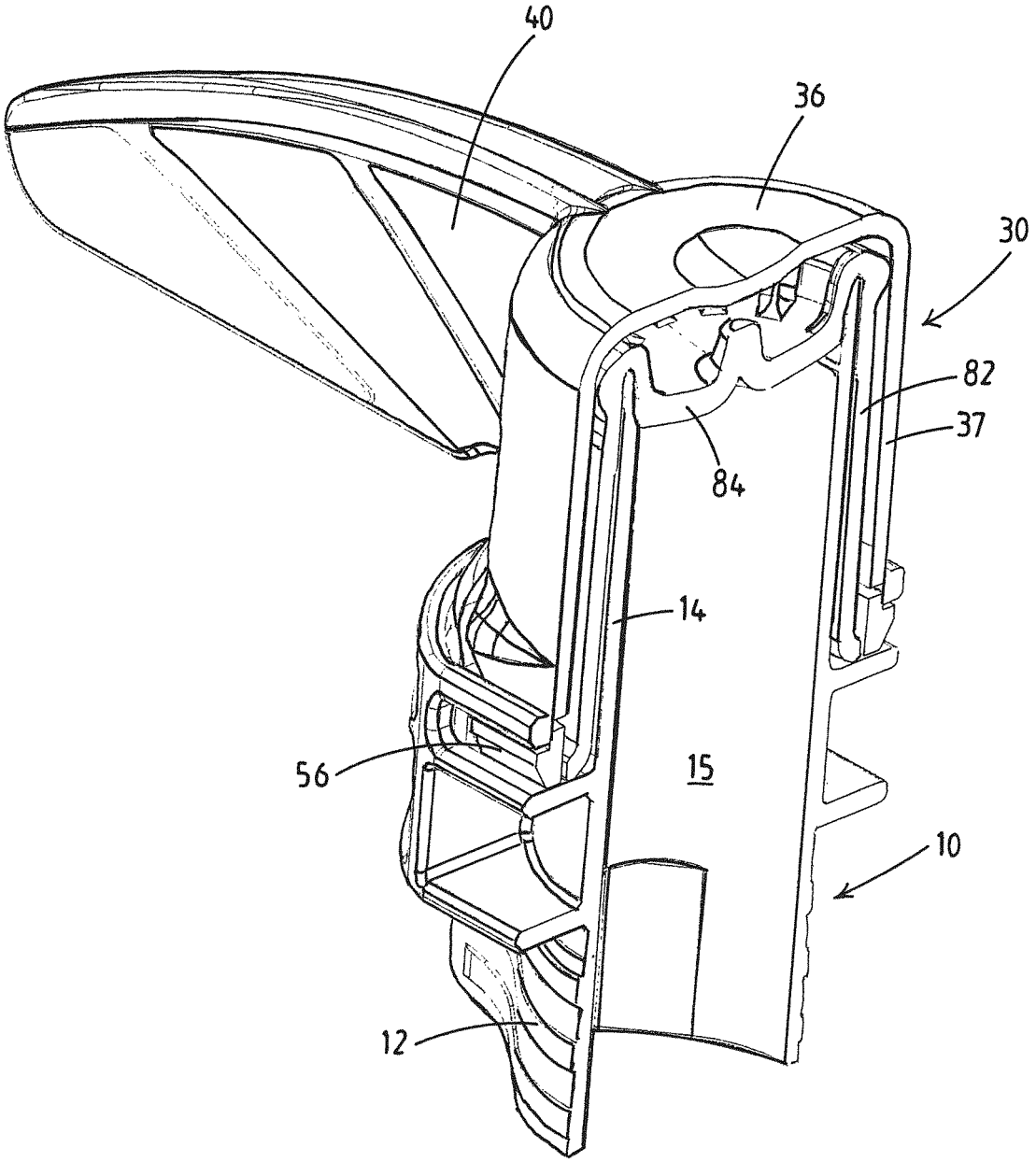
Figure 14:
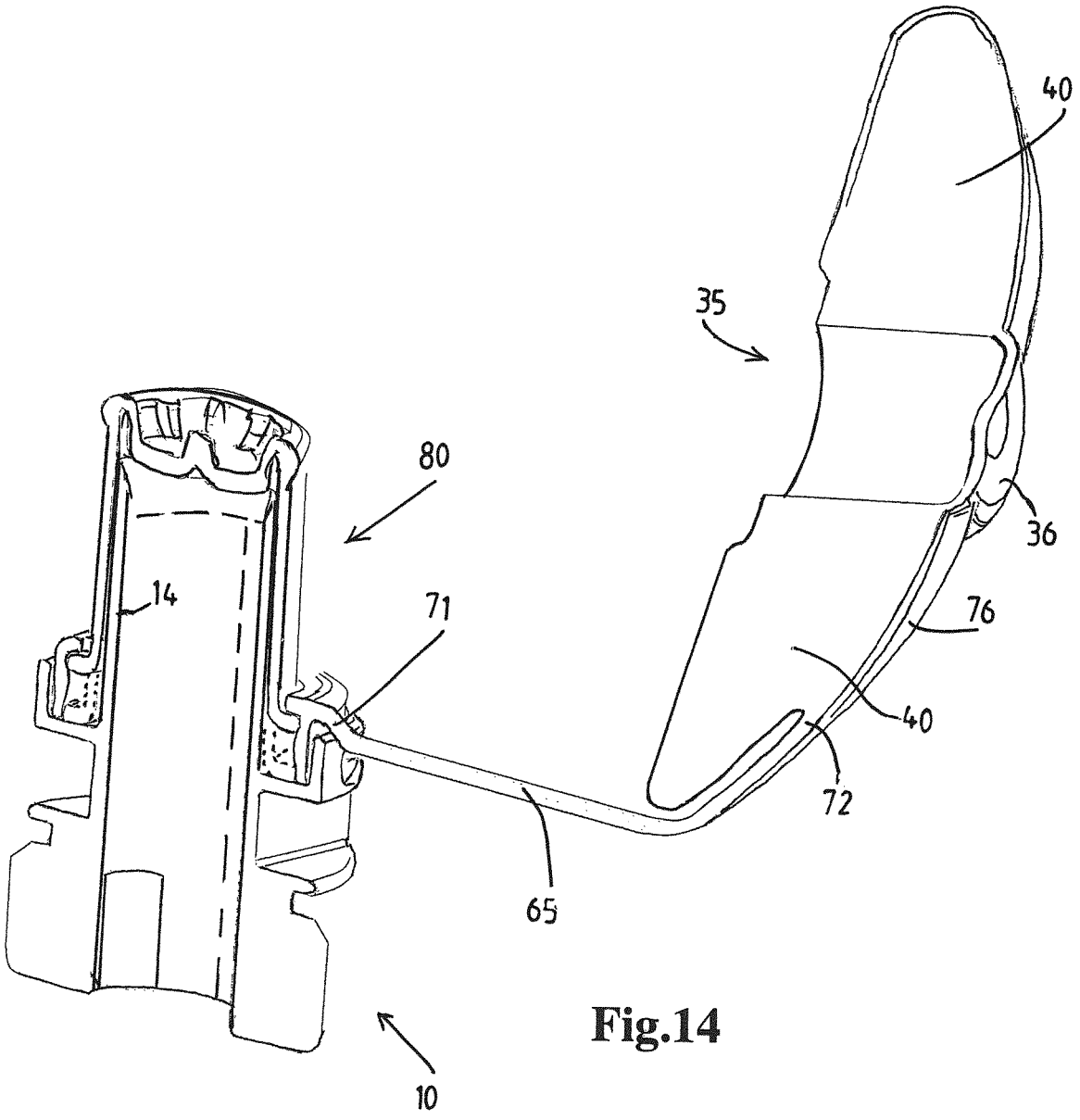
Figure 15:
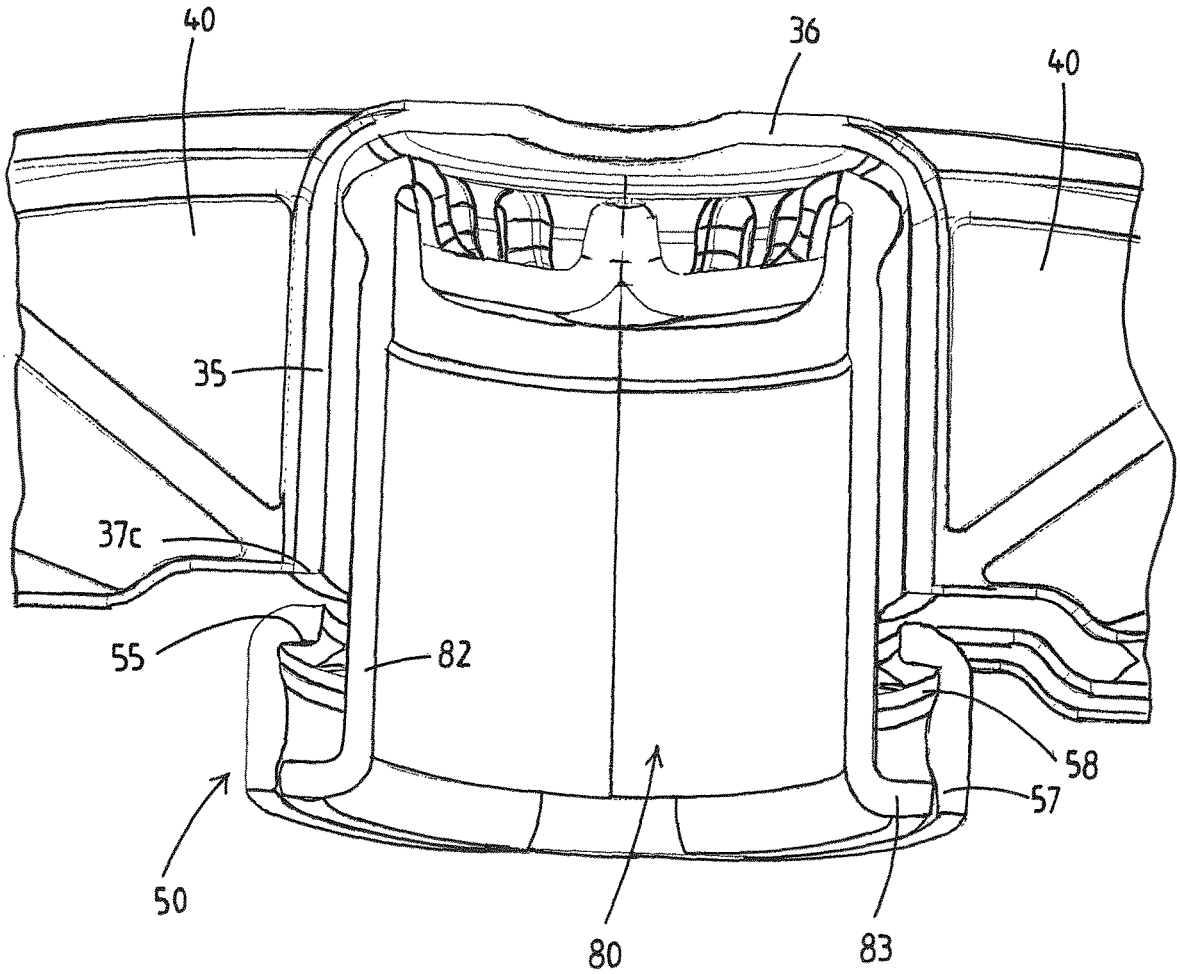
Figure 16:
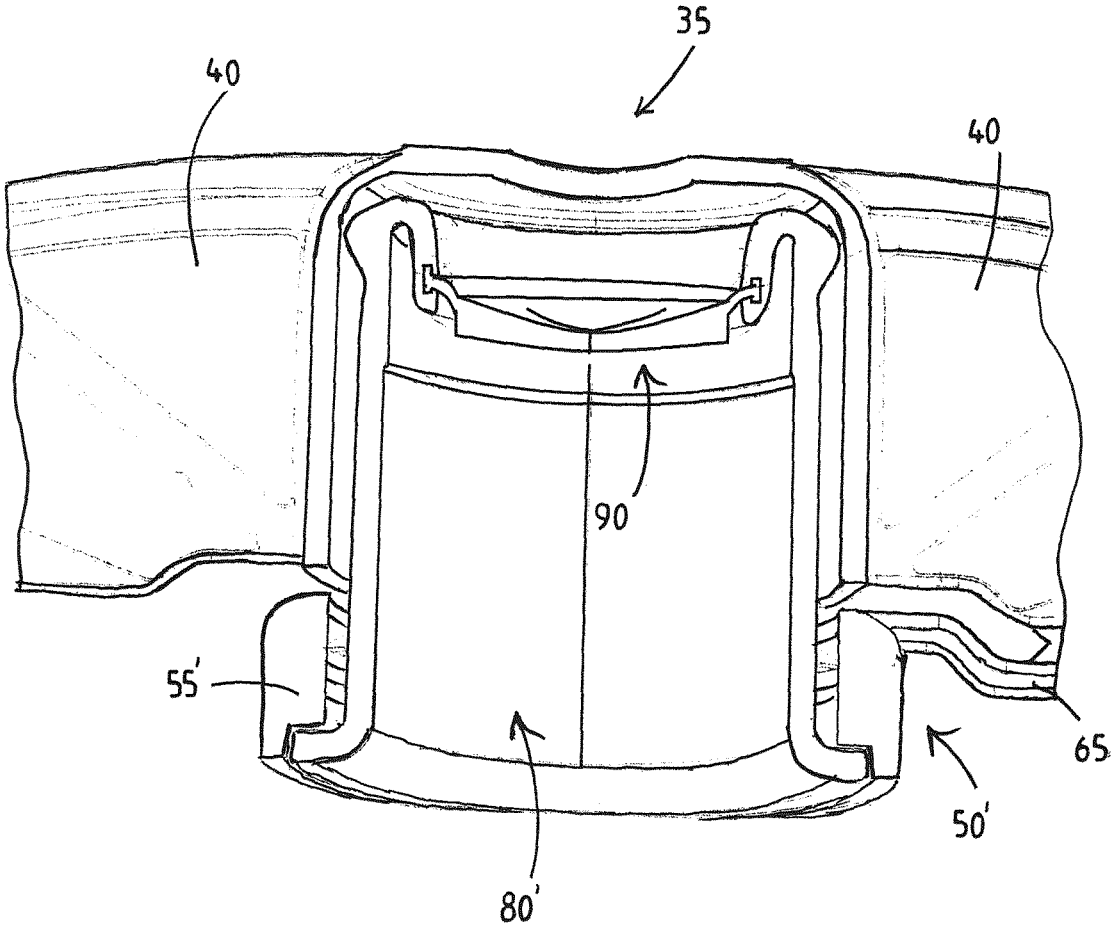
Figure 17:
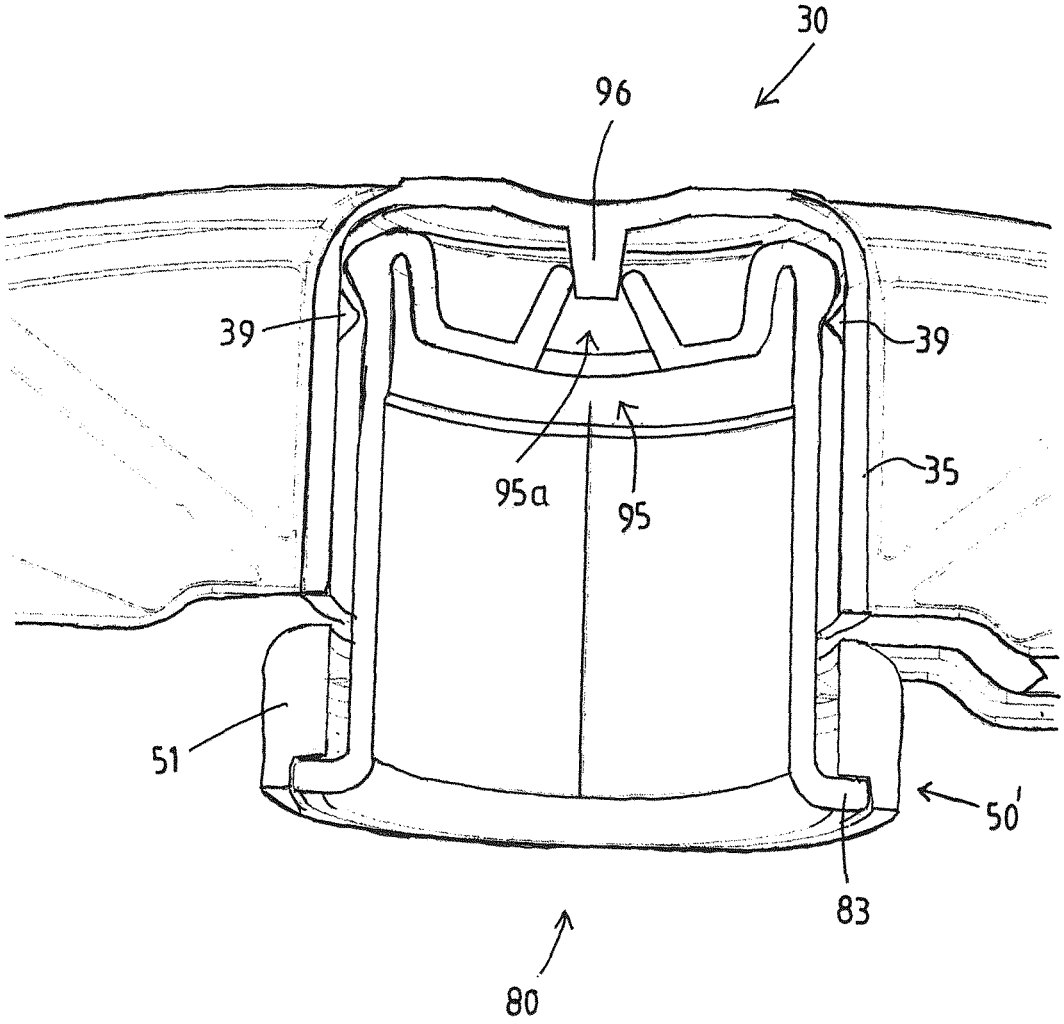

FIG. 3 shows the closure assembly of the pouch of FIGS. 1, 2 in closed condition, FIG. 4 shows an exploded view of the three components of the closure assembly of FIG. 3, FIG. 5 shows the three components from a different angle, FIG. 6 shows the spout of the closure assembly, FIG. 7 shows the slidable valve member of the closure assembly of FIG. 3 mounted to the neck of the spout and in closed position, FIG. 8 shows a vertical cross-section of FIG. 7, FIG. 9 shows a vertical cross-section of the slidable valve member of the closure assembly of FIG. 3, FIG. 10 shows the cap unit of the closure assembly of FIG. 3, FIG. 11 shows a vertical cross-section of the cap unit of the closure assembly of FIG. 3, FIG. 12 shows a vertical cross-section of the closure assembly of FIG. 3, FIG. 13 shows another vertical cross-section of the closure assembly of FIG. 3, FIG. 14 shows the closure assembly of FIG. 3 with the cap body removed and with the slidable valve member in the opened position thereof, FIG. 15 shows a subassembly of the cap unit and the slidable valve member of the closure assembly of FIG. 3, prior to the snap-fitting of the cap unit onto the spout, FIG. 16 shows a variant of the subassembly, wherein the flow control device is embodied as a slit valve, FIG. 17 shows another variant of the subassembly, wherein the flow control device is embodied as a flow restrictor.

In the appended FIGS. 1-15 a first exemplary embodiment of a spouted pouch with closure assembly according to the invention is illustrated.

The spouted pouch 1 has a flexible material pouch body 2 that is filled with a product to be dispensed, e.g. a liquid, e.g. a liquid food product, e.g. a beverage, or some other liquid product, e.g. soap, crème, detergent, non-edible oil, etc. As preferred, the pouch body is made of heat-sealable film material, e.g. of film material having one or more layers of plastic.

The spouted pouch is provided with a three-component closure assembly 5, that is composed of:

a spout 10, a cap unit 30, and a flow control device 80.

As is common in the field the spout has a spout body 11, e.g. injection moulded of plastic material.

For example, the spout 10 is molded of plastic, preferably as a unitary spout body, e.g. of polyethylene (PE) or of polypropylene (PP).

The spout body has, in a lower end or region thereof, an attachment portion 12 that is attached to a flexible material pouch body. The depicted spout 10 is adapted to be secured with the portion 12 thereof between opposed film walls of a collapsible pouch 1. The portion 11 here is essentially boat-shaped or canoe in horizontal cross-section but other shapes, e.g. oval, elliptical, circular, diamond, etc., are also possible.

As is common in the art said attachment may involve heat sealing, wherein the material of the pouch is heat sealed to the portion 12. The spout body 11 further has a tubular neck 14 that extends upward from the attachment portion 12. The neck 14 delimits a section of a product passage 15 that extends through the spout body 12.

The neck 14 has a lower end integral with the attachment portion 12, an upper end having an upper rim 16 about an upper opening 17 of the passage 15 The neck 14 has an interior surface 18 and an exterior surface 19.

The cap unit 30 comprises a cap body 35, an integrated ring member 50, and, as preferred, an integrated strap 65 permanently securing the cap body 35 to the ring member 50.

The cap unit 30 is made, e.g. moulded, as one piece of plastic material distinct from the spout 10.

The cap body 35 comprises a top wall structure 36 and a downward depending skirt 37, which has an interior side 37*a*, an exterior side 37*b*, and a lower edge 37*c* remote from the top wall structure 36.

The ring member 50 is integrally formed to the lower edge 37*c* of the skirt 37 of the cap body.

The ring member comprises an annular base portion 51 which is connected via breakable bridges 53 to the skirt 37 of the cap body 35. These breakable bridges 53 break upon first time removal of the cap body by a user for dispensing of product from the pouch 1.

The annular base portion 51 and the spout body 11 have cooperating permanent snap-fit joint portions that keep the ring member 50 fixed to the spout 10 upon removal of the cap body 35 by the user.

In this example, generally as described in WO2017/135824, the spout body is an integrally formed circumferential wall portion 20 that extends coaxially about a section of the neck to form an inner space 22 that is open from above for receiving the annular base portion 51 of the ring member therein. The wall portion 20 has at least one snap-fit feature for cooperation with a snap-fit feature of the base portion to form a permanent snap-fit.

It is illustrated that the circumferential wall 20 is erected on a circumferential flange 11*a* of the spout body that extends around the neck 14. In this example, as preferred, the spout body has an upper flange 11*a* and a lower flange 11*b*, e.g. allowing for handling of the spout as is known in the art.

It is illustrated that the wall portion 21 has multiple windows 21 therein, distributed about the circumference of the wall portion. The base portion has outwardly protruding snap portions 56 that each snap into a corresponding window 21.

It is illustrated, as an example, that the wall portion has two sets of windows 21 for two sets of snap portions 56 at opposed sides of the neck, e.g. aligned in the plane of the top edge of the pouch.

The wall portion 20 has, preferably in addition to the windows 21, one or more further windows 23, here two windows arranged diametrically opposite relative to the neck 14. These further windows 23 each cooperate with another snap portion 56.

In another embodiment, not shown, the further windows 23 each cooperate with a latch tab of the overcap 35 in order to provide a releasable snap connection between the overcap 35 and the spout.

When placing the cap unit 30 on the spout, e.g. as preferred with the flow control device 80 being pre-assembly with the cap unit as a subassembly, the ring member 50 enters the inner space 21 and snaps into place.

Advantageously, the presence of the circumferential wall portion 20 provides a shield that shields the ring member 50 that has been introduced in the inner space 21. The ring member 50 is shielded by the wall 20 which reduces a risk of an undesired release of the ring member 50 once the cap body 35 has been removed. The wall 20 may make it more difficult to loosen the ring member 50 by an act from the outside, like for example releasing the ring member 50 by nibbling on the neck of an opened closure assembly.

The flow control device 80 here is embodied to create a push-pull valve of the spouted pouch 1. The flow control device 80 is mounted to the neck 14 and has an external part, here embodied as a collar 81, that is located outside of the exterior surface of the neck 14. The flow control device 80 is configured to provide control of the flow of product from the pouch body through the product passage 15.

In the closed condition of the spouted pouch, the cap body 35 is arranged over the neck 14 and the flow control device 80.

As will be explained in more detail below, and as can be seen in the figures, the ring member 50 and the external part 82 of the flow control device have cooperating retention portions 55, 83 that retain the flow control device 80 relative to the spout 10.

In more detail, the depicted flow control device 80 is a slidable valve member that is mounted on the neck 14 so as to be slidable upward relative to the neck 14 from a closed position to an opened position (see FIG. 15) to open the product passage 15 and downward to the closed position to close the product passage.

The flow control device 80 is embodied to provide a closed position, so the functionality to keep the product passage closed. The cap body 35 is embodied as a protective overcap, so lacking the functionality to close the product passage 15. As is known in the art, the protective overcap 35 primarily serves to shield the neck 14 and flow control device 80 from access prior to removal of the cap body 35.

The flow control device 80 is molded of plastic material, e.g. as one piece, e.g. of PE or PP.

It is illustrated that the cap body 35, with the bridges 53 still intact, prevents the slidable valve member 80 from being moved into the opened position, e.g. by internal pressure and/or by external tampering.

The slidable valve member 80 has one or more sealing surfaces cooperating with one or more sealing surfaces of the neck of the spout in the closed position.

As is illustrated, the retention portions define the opened position of the slidable valve member and prevent further upward motion of the valve member 80.

As illustrated, the external portion of the slidable valve member is embodied with a collar 82 that extends around the exterior of the neck and with one or more outward protrusions forming one or more retention portions, here a flange 83 at a lowermost edge of the collar 82.

The ring member 50 is configured to allow for up and down sliding of the slidable valve member 82. The ring member 50 comprises a retention portion 55 forming an abutment for the outward protrusion, here flange 83, which abutment limits the upward motion of the slidable valve member relative to the neck and defines the opened position of the slidable valve member 82.

It is illustrated that the ring member and the slidable valve member have cooperating snap-fit portions that create a releasable snap-fit in at least one of the opened and the closed position of the slidable valve member, here in both the opened and closed position. Here, the annular base portion 51 of the ring member defines two snap-fit recesses 57, 58 at different heights for a portion of the outer periphery of an outward protrusion, here flange 83, of the slidable valve member 82. The lower recess 57 receives the flange 83 therein in a releasable snap-fit when the valve member 82 is in the closed position, and the upper recess 58 receives therein the flange 83 in the opened position of the valve member, again in a releasable snap fit.

It is illustrated that a light snap is provided for between the overcap body 35 and the flow control device 80 in combination with a stronger snap between the flow control device 80 and the spout 10. Here, the stronger snap provided by recess 58 cooperating with flange 83 will hold the slidable valve member 80 in its closed position as the user removes the overcap body 35 through release of a lighter snap between the overcap body and the member 80, e.g. as provided by one or more snap formations 39 (see FIG. 11) on the inside of the cap body 35 engaging underneath, or otherwise interacting with, a portion of the collar 82.

As illustrated, the one or more sealing surfaces are located in proximity of the open upper end of the neck 14.

An internal or first seal is formed between a sealing surface 18*a* on the inner surface 18 of the neck 14 and a sealing surface 86 of an inner annular wall portion 85 of the slidable valve member that extends into the neck 14.

An external, or second seal, is formed between a sealing surface 19*a* on the exterior surface of the neck and a sealing surface 82*a* of the collar 82 of the slidable valve member 80.

It is illustrated that the slidable valve member 80 has a transverse central wall portion 84 and adjoining along a periphery thereof an upwardly extending inner annular wall portion 85 forming a sealing surface 86 of the internal seal that cooperates with a sealing surface on the inner surface of the neck. The inner annular wall portion 85 connects via a bridge wall portion 87 to the top end of the collar 82 that extends coaxially about the inner annular wall portion 85. An open-bottomed groove 88 is present between the collar 82 and the coaxial inner annular wall portion 85. At least in the closed position, the upper end of the neck 14 is received in the groove 88.

The valve member 80 is provided with outflow openings 89 which come into communication with the interior of the neck when the valve member is moved into the opened position so as to disengage the internal seal.

For discharge of product from the pouch 1, the user first removes the cap body 35 in which process the bridges 53 break evidencing the first time opening of the closure assembly. Then the user has access to the slidable valve member 80, which is then slid upward by the user from the initial closed position into the opened position. This opened condition of the closure assembly is depicted in FIG. 15.

In the opened position of the slidable valve member 80 the internal seal is disengaged, allowing for product flow out of the pouch via the outflow openings 89 in the valve member 80. The external seal between the neck 14 and the collar 82 is maintained in the opened position, so that no product will be discharged via said route and only via the outflow openings 89.

FIG. 15 illustrates a subassembly of the cap unit 35 and the flow control member 80 prior to mounting on the spout 10. For example, as depicted, the flow control member 80 is snap-fitted with a releasable, e.g. light, snap-fit join in the cap unit. For example, this releasable snap-fit is provided by the lower recess 57 which receives the flange 83 therein.

The subassembly allows for an effective method for the production of filled spouted pouches 1. The method comprises:

providing an empty pouch with a spout 10 attached to the pouch body 2, filling the pouch with product via the product passage 15, providing the subassembly of the cap unit 30 and the flow control member 80, wherein the flow control member is initially retained within the cap body, mounting the subassembly on the spout 10 after filling of the pouch, said mounting involving pressing the subassembly onto the spout 10 so that the flow control device becomes mounted to the neck 14 and so that the cooperating permanent snap-fit joint portions 56, 21, 23 of the annular base portion and the spout body engage and keep the ring member fixed to the spout.

FIG. 16 shows a variant of the subassembly, wherein the flow control device 80' is embodied as a slit valve 90. In this embodiment, the cooperating retention portions 55' of the ring member 50' and of the flow control device retain the flow control device relative to the spout in one fixed position, so immobile relative to the spout. This is envisaged as the slit valve 90 requires no motion relative to the neck.

FIG. 17 shows another variant of the subassembly, wherein the flow control device 80" is embodied as a flow restrictor 95 having one or more outflow openings 95, here one, that have a smaller cross-section than the product passage delimited by the spout 10. For this flow control functionality, the device 80" need not be mobile relative to the neck, at least not up and down. So, as shown, the ring member 50' keeps the device 80" in one fixed position.

It is illustrated in FIG. 17 that the cap body 35 now has a closing functionality, as the closing portion 96 thereof sealingly cooperates with the flow control device 80 to hermetically close the pouch in the closed position of the cap body 35. In the art many designs of such functionality are known and can be implemented in the context of the invention. The FIG. 17 serves as a simple example.

As illustrated the cap unit 30 comprises a cap body 35 embodied as a protective overcap, an integrated ring member 50, and, as preferred, an integrated strap 65 permanently securing the cap body 35 to the ring member 50'.

The cap body comprises one or more, here a pair of wing-shaped handles 40, here just one pair of wing-shaped handles, the one or more wing-shaped handles extending outwardly from the skirt 37, here in mutually opposite directions. These handles are configured to be engaged by a user for removal of the cap body.

It is illustrated, as is preferred, the strap 65 is integral at a first end 71 thereof to the base portion 51 of the member 50 and at a second end 72 thereof integral to one of the wing-shaped handles 40. The strap 65 is adapted to remain connected to both the base portion of the ring member and the respective wing-shaped handle upon removal of the overcap by the user.

It is illustrated, as is preferred, that the strap 65, prior to first time removal of the overcap by the user, is located in a plane, e.g. in a vertical plane, that is in common with a panel portion of the respective wing-shaped handle 40.

It is illustrated that the strap 65 extends outward from the base portion 51 towards a tip of the respective wing-shaped handle along the bottom side of the wing-shaped handle, further about the tip of the wing-shaped handle, and then along a portion of the top side of the wing-shaped handle to the second end 72 of the strap. As preferred, the second end is located inward of the tip of the handle 40, yet at a distance outward of the skirt 32.

It is illustrated, that the handles 40 each have at least one reinforcing top protrusion 76 that is integral with at least a portion of the top side of the panel portion of the respective handle 40 and which top protrusion protrudes away from main face of the panel portion so as to reinforce the panel, e.g. in view of forces applied by the user upon rotating the cap body for removal thereof.

It is illustrated, that the strap 65 is integral at a first end thereof to the base portion of the ring member and extends from the first end 71 along the bottom side of the panel portion about the tip of the panel portion to a second end 72 of the strap, wherein the second end of the strap adjoins the outer end of the reinforcing top protrusion 76.

It is illustrated, as is preferred, that the cap unit comprises one or more breakable tamper-evident bridges 74 that are located between the strap 65 and the respective wing-shaped handle 40, said one or more breakable tamper-evident bridges 74 breaking upon first time removal of the overcap by a user. In the depicted example, an integrally molded breakable film portion 74 extends over a major part of the length of the strap 65 between the handle 40 and the strap 40. Upon removal of the overcap 35 this film portion 74 is torn.

It is illustrated, as is preferred, that the cap unit is embodied with a quarter turn lift overcap 35. So, in general, the user will turn the overcap over about a quarter turn in the process of removal of the overcap.

It is illustrated, e.g. in FIG. 10, that the ring member 50 is provided with at least one, here two diametrically opposed, first cam portion 61 which defines a cam surface 62, which cam surface 62 is angled with respect to a main axis of the neck 14. The first cam portion 61 is integrally formed on the annular base portion 51 of the ring member 50.

It is illustrated that the skirt of the overcap 35, at the lower edge thereof, is provided with at least one, here two diametrically opposed, second cam portion 63 defining a cam follower surface 64 adapted to interact with the cam surface 62 of the first cam portion 61.

It is illustrated that the second cam portions 63 each are part of a downwardly extending tab 38 integrally formed at the lower end of the skirt and adapted to cooperate with the first cam surface 62. As shown, the cap body has two tabs 38 extending downwardly at diametrically opposed positions.

Upon first time opening by rotation of the overcap 35 relative to the neck about the main axis of the neck, the first and second cam portions 61, 63 interact in order to cause axial lifting of the overcap relative to the neck 14, e.g. enhancing that the bridges 53 break and any co-operating snap connector formations between the overcap 35 and the spout disengage.

It is illustrated that each first cam portion 61 has an upwardly arched first cam surface 62 with a centre and with first and second ends where the arched first cam surface adjoins the top face 54*a* of the flange-like portion 51. A breakable bridge 53 is present at each end of the upwardly arched first cam surface 62.

It is illustrated that a top region of the annular base portion 51 protrudes upwardly above the circumferential wall 20 and that the strap 65 adjoins at the first end thereof 71 this upwardly protruding top region. As preferred, the top region is part of the cam portion 61 on the ring member 50.

In another embodiment, the tabs 38 could have the dual function of providing the second cam portion 63 as well as being embodied as a latch tab to provide a releasable snap connection between the overcap 35 and the spout, which snap connection is also of use after the first time opening allowing the user to close the pouch again.

When placing the overcap 35 back onto the spout, e.g. latching the overcap 35 as described herein, the user automatically pushes the slidable valve member 82 down into the closed position thereof, as is preferred.

What is claimed is:

1. A spouted pouch comprising:

a flexible material pouch body filled with a product to be dispensed, a spout having a spout body with an attachment portion that is attached to a flexible material pouch body, wherein said spout body has a tubular neck extending upward from said attachment portion, which neck delimits a section of a product passage that extends through the spout body, said neck having an exterior surface, a cap unit comprising a cap body and an integrated ring member, which cap unit has been made, e.g. moulded, as one piece of plastic material that is distinct from the spout, wherein the cap body comprises a top wall structure and a downward depending skirt having an interior side, exterior side, and a lower edge remote from the top wall structure, wherein the ring member is integrally formed to the lower edge of the skirt of the cap body, said ring member comprising an annular base portion which is connected at least via one or more breakable bridges to the skirt of the cap body, said one or more breakable bridges breaking upon first time removal of the cap body by a user for dispensing of product from the pouch via the product passage, wherein the annular base portion and the spout body have cooperating permanent snap-fit joint portions that keep the ring member fixed to the spout upon removal of the cap body by the user, characterized in that the spouted pouch further comprises:

a flow control device which has been made distinct from the spout and from the cap unit, which flow control device is mounted to the neck and has an external part that is located outside of the exterior surface of the neck, which flow control device is configured to provide control of the flow of product from the pouch body through the product passage, wherein the cap body is arranged over the neck and the flow control device, and wherein the ring member and the external part of the flow control device have cooperating retention portions that retain the flow control device relative to the spout.

2. The spouted pouch according to claim, 1, wherein the flow control device is a slidable valve member that is mounted on the neck so as to form a push-pull valve and so as to be slidable upward relative to the neck from a closed position to an opened position to open the product passage and downward to the closed position to close the product passage, wherein the slidable valve member has one or more sealing surfaces cooperating with one or more sealing surfaces of the neck of the spout in the closed position, and wherein the retention portions limit the upward motion of the slidable valve member.

3. The spouted pouch according to claim 2, wherein the external portion of the slidable valve member is embodied with a collar that extends around the exterior of the neck and with one or more outward protrusions forming one or more retention portions, and wherein the ring member is configured to allow for said up and down sliding of the slidable valve member, the ring member comprises a retention portion forming an abutment that limits the upward motion of the slidable valve member.

4. The spouted pouch according to claim 2, wherein the one or more sealing surfaces are located in proximity of the upper end of the neck and comprise an internal seal formed between a sealing surface on the inner surface of the neck and a sealing surface of an inner annular wall portion of the slidable valve member that extends into the neck.

5. The spouted pouch according to claim 2, wherein the slidable valve member has a transverse central wall portion and adjoining along a periphery thereof an upwardly extending inner annular wall portion forming a sealing surface of an internal seal that cooperates with a sealing surface on the inner surface of the neck, wherein the inner annular wall portion connects via a bridge wall portion to the top of the collar that extends coaxially about the inner annular wall portion, wherein an bottomed groove is present between the collar and the inner annular wall portion wherein the upper end of the neck is received.

6. The spouted pouch according to claim 1, wherein the flow control device is embodied as a valve, and wherein the cap body is embodied as a protective overcap.

7. The spouted pouch according to claim 1, wherein the cap body is a snap-on type cap body providing a snap-on functionality so that the cap body can be replaced after first time removal, wherein the spout and/or the flow control device on the one hand and the cap body on the other hand are provided with cooperating snap connector formations to provide the snap-on functionality.

8. The spouted pouch according to claim 1, wherein the cap body comprises a pair of wing-shaped handles, said wing-shaped handles extending outwardly from the skirt in mutually opposite directions and being configured to be engaged by a user for removal of the cap body.

9. The spouted pouch according to claim 1, wherein the cap unit further comprises an integrated strap permanently securing the cap body to the ring member.

10. The spouted pouch according to claim 1, wherein the cap unit is embodied with a turn lift functionality and comprises:

at least one first cam portion defining a cam surface, which cam surface is angled with respect to a main axis of the neck, which first cam portion is integrally formed on one of the lower edge of the skirt and the ring member, and at least one second cam portion defining a cam follower surface adapted to interact with the cam surface of the first cam portion and which second cam portion is integrally formed on the other one of the lower edge of the skirt and said ring member, wherein, upon first time opening by rotation of the cap body relative to the neck about the main axis, the first and second cam portions interact in order to cause axial lifting of the cap body relative to the neck.

11. A closure assembly for a spouted pouch, the closure assembly comprising:

a spout having a spout body with at a lower end thereof an attachment portion that is configured to be attached to a flexible material pouch body, wherein said spout body has at an upper end thereof a tubular neck, which neck delimits a section of a product passage that extends through the spout body, said neck having an exterior surface, a cap unit comprising a cap body, an integrated ring member, and, optionally, an integrated strap permanently securing the cap body to the ring member, which cap unit is made, e.g. moulded, as one piece of plastic material distinct from the spout, wherein the cap body comprises a top wall structure and a downward depending skirt having an interior side, exterior side, and a lower edge remote from the top wall structure, wherein the ring member is integrally formed to the lower edge of the skirt of the cap body, said ring member comprising an annular base portion which is connected at least via one or more breakable bridges to the skirt of the cap body, said one or more breakable bridges breaking upon first time removal of the cap body by a user for dispensing of product from the pouch, wherein the annular base portion and the spout body have cooperating permanent snap-fit joint portions that are configured to keep the ring member fixed to the spout upon removal of the cap body by the user, characterized in that the assembly further comprises:

a flow control device which is made distinct from the spout and from the cap unit, which flow control device is configured to be mounted to the neck and has an external part that is located outside of the exterior surface of the neck when the control device has been mounted to the neck, which flow control device is configured to provide control of the flow of product from the pouch body through the product passage, wherein the cap body is configured to be arranged over the neck and the flow control device when mounted to the neck, and wherein the ring member and the external part of the flow control device have cooperating retention portions that are configured to retain the flow control device relative to the spout.

* * * * *